US008785100B2

(12) United States Patent
Motani et al.

(10) Patent No.: US 8,785,100 B2
(45) Date of Patent: Jul. 22, 2014

(54) TWO-COMPONENT DEVELOPER

(71) Applicants: Hitomi Motani, Tokyo (JP); Tomoko Mine, Tokyo (JP); Tomomi Oshiba, Tokyo (JP)

(72) Inventors: Hitomi Motani, Tokyo (JP); Tomoko Mine, Tokyo (JP); Tomomi Oshiba, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/727,980

(22) Filed: Dec. 27, 2012

(65) Prior Publication Data

US 2013/0189612 A1 Jul. 25, 2013

(30) Foreign Application Priority Data

Jan. 20, 2012 (JP) ..... 2012-010027

(51) Int. Cl.
*G03G 9/113* (2006.01)

(52) U.S. Cl.
USPC ..... 430/111.33; 430/111.32; 430/111.35

(58) Field of Classification Search
USPC ..... 430/111.1, 111.32, 111.33, 111.35
See application file for complete search history.

(56) References Cited

U.S. PATENT DOCUMENTS

| | | | | |
|---|---|---|---|---|
| 5,631,116 | A | 5/1997 | Uchida et al. | |
| 2001/0003634 | A1* | 6/2001 | Ohmura et al. | 430/108.2 |
| 2009/0214971 | A1* | 8/2009 | Yoshida et al. | 430/97 |

FOREIGN PATENT DOCUMENTS

| | | |
|---|---|---|
| JP | 07-261462 | * 10/1995 |
| JP | 09-190007 | 7/1997 |
| JP | 3691085 | 6/2005 |

OTHER PUBLICATIONS

AIPN Japanese Patent Office machine-assisted English-translation of JP 07-261462 (pub. Oct. 1995).*
Japanese Office Action, Notification of Reasons(s) for Refusal, Patent Application No. 2012-010027, Dispatch Date: Feb. 25, 2014 (3 pages).
English translation of Japanese Office Action, Notification of Reasons(s) for Refusal, Patent Application No. 2012-010027, Dispatch Date: Feb. 25, 2014 (3 pages).

* cited by examiner

*Primary Examiner* — Janis L Dote
(74) *Attorney, Agent, or Firm* — Lucas & Mercanti, LLP

(57) ABSTRACT

The present invention relates to a two-component developer which comprises a toner, and a carrier having a surface of a core material particle coated with a resin having a unit of general formula (1). The present invention provides a two-component developer which has enhanced environmental stability of carrier charging performance.

20 Claims, 3 Drawing Sheets

TWO-COMPONENT DEVELOPER

CROSS-REFERENCE TO RELATED APPLICATION

This application is based on Japanese Patent Application No. 2012-10027 filed on Jan. 20, 2012, the contents of which are incorporated herein by reference.

BACKGROUND

1. Technical Field

The present invention relates to a two-component developer used in an image forming apparatus of an electrophotographic system represented by copying machines and printers.

2. Description of Related Arts

In recent years, copying machines and printers of electrophotographic system have been subjected to attempts to increase a printing speed, and among developers used in those apparatuses, two-component developers that are advantageous in high-speed development have been in the mainstream. A two-component developer is composed of a magnetic powder called a carrier, and a toner. It is believed that a two-component developer is advantageous in high-speed development since a desired amount of electric charge can be rapidly given to a toner by mechanically stirring the toner and a carrier. Functions required for a carrier include frictional chargeability appropriate to a toner, fluidity, developability, high durability capable of withstanding long-term use, and the like. In order to enhance these functions, a carrier of a type called resin-coated carrier, which is formed by coating a surface of core material particles that are formed of a ferromagnetic metal or an oxide thereof with a resin, has been widely used.

An example of the resin used for the resin-coated carrier (hereinafter, also referred to as resin for coating) is a resin formed by polymerizing a methacrylic acid cycloalkyl ester which is an alicyclic methacrylic acid ester. Although a carrier formed by using the resin has excellent frictional chargeability and excellent moisture resistance, it has problems such that after long-term endurance, the resin layer (hereinafter, also referred to as coating resin layer) may be detached from the surface of the core material particles due to friction, and contamination caused by the attachment or embedment of an external additive to the toner is likely to occur to induce decrease in amount of electric charge. As a measure against such friction of the resin for coating, for example, it has been suggested in Japanese Patent No. 3691085 that friction properties may be significantly improved by using a resin produced by copolymerizing a chain methacrylic acid ester with an alicyclic methacrylic acid ester.

SUMMARY

However, the resin produced by copolymerizing a chain methacrylic acid ester with an alicyclic methacrylic acid ester as described in Japanese Patent No. 3691085, has inferior moisture resistance as compared with a resin produced by polymerizing an alicyclic methacrylic acid ester or a chain methacrylic acid ester alone. Accordingly, there has been a problem that an amount of electric charge is markedly decreased particularly in a high temperature and high humidity environment.

Thus, it is an object of the present invention to provide a two-component developer which represses decrease in chargeability in a high temperature and high humidity environment and enhances environmental stability of carrier charging performance.

To achieve at least one of the above-mentioned objects, a two-component developer reflecting one aspect of the present invention comprises a toner, and a carrier having a surface of a core material particle coated with a resin for coating, wherein the resin for coating is a vinyl polymer having a unit having at least a cycloalkyl group or a phenyl group of the following general formula (1):

General Formula (1)

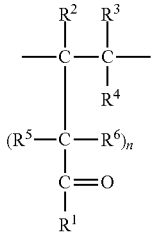

wherein $R^1$ represents an optionally substituted cycloalkyl group or an optionally substituted phenyl group; $R^2$ represents a hydrogen atom or a methyl group; $R^3$ and $R^4$ each represent a hydrogen atom; $R^5$ and $R^6$ each independently represent a hydrogen atom or an alkyl group; and n is an integer of 0 or greater.

DETAILED DESCRIPTION

Hereinafter, embodiments of the present invention will be described with reference to the attached drawings. Meanwhile, the same reference number will be assigned to the same element in the description of the drawings, and any overlapping parts in the descriptions will not be repeated. Furthermore, the dimensional ratios of the drawings may be exaggerated for convenience of explanation, and may be different from the actual ratios.

The two-component developer of the present invention comprises a toner, and a carrier having a surface of a core material particle coated with a resin for coating, wherein the resin for coating is a vinyl polymer (including both a homopolymer and a copolymer) having a unit of the following general formula (1):

General Formula (1)

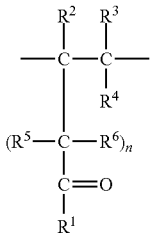

wherein $R^1$ represents an optionally substituted cycloalkyl group or an optionally substituted phenyl group; $R^2$ represents a hydrogen atom or a methyl group; $R^3$ and $R^4$ each represent a hydrogen atom; $R^5$ and $R^6$ each independently represent a hydrogen atom or an alkyl group; and n is an integer of 0 or greater. As used herein, the vinyl polymer having the unit of the general formula (1) is also referred to as "vinyl polymer according to the present invention" or "vinyl polymer having an optionally substituted cycloalkyl group or an optionally substituted phenyl group". Particularly, even in a high temperature and high humidity environment, leakage of charge does not occur, and decrease in an amount of electric charge can be suppressed.

Hereinafter, the respective constituent elements of the two-component developer of the present invention will be described in detail.

(Two-Component Developer)

The two-component developer of the present invention can be obtained by mixing a toner with a specific carrier. The two-component developer is used in the formation of black-and-white print images or in the formation of full-color print images.

(Carrier 1)

Figure 1:
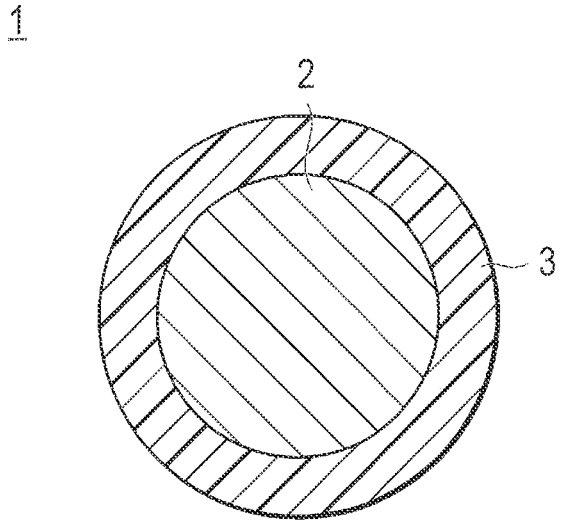
FIG. 1 is a cross-sectional diagram schematically illustrating an embodiment of a carrier of a two-component developer according to the present invention. In the FIG. 1, reference numeral 1 represents a carrier; reference numeral 2 represents a core material particle; and reference numeral 3 represents a resin layer.

FIG. 1 is a cross-sectional diagram schematically illustrating an embodiment of the carrier of the two-component developer according to the present invention. As illustrated in FIG. 1, the carrier 1 is composed of a core material 2 particle, and a coating resin layer 3 that covers the surface of the core material 2 particle with a resin for coating.

The carrier 1 will be described separately in terms of the core material 2 particle and the coating resin layer 3.

(Material of Core Material 2 Particle)

The material of the core material 2 particle (a magnetic material particle) to be used in the present invention may include substances that are strongly magnetized by a magnetic field in the direction of the magnetic field, for example, metals exhibiting ferromagnetism, such as iron, nickel and cobalt, including iron powder, various ferrites, specifically ferrites represented by formula (a): $MO.Fe_2O_3$, and various magnetites, specifically magnetites represented by formula (b): $MFe_2O_4$, as well as alloys or compounds containing these metals; alloys that do not include ferromagnetic elements but acquire ferromagnetism when appropriately heat-treated, for example, Heusler alloys such as manganese-copper-aluminum and manganese-copper-tin, as well as particles of chromium dioxide; and dispersions thereof in a resin (a binder resin). Preferred examples of the material include various magnetites and various ferrites.

In the above formulas (a) and (b) M represents a divalent or monovalent, metal, for example, Mn, Fe, Ni, Co, Cu, Mg, Zn, Cd, or Li. These metals can be used singly, or plural kinds can be used in combination.

Among these, from the viewpoint that the specific gravity is smaller than a metal such as iron and nickel, and weight reduction can be promoted so that the impact force that is exerted to a toner during stirring in a developing machine can be reduced, it is preferable to use various ferrites.

As such ferrites, for example, ferrites containing heavy metals such as Cu, Zn, Ni and Mn, light metal ferrites containing any of alkali metals and alkaline earth metals, and light metal ferrites containing heavy metals such as Cu, Zn, Ni and Mn and an alkali metal or an alkaline earth metal are preferred. Light metal ferrites are more preferred, and particularly preferred ferrites are light metal ferrites containing any of alkali metals and alkaline earth metals, and light metal ferrites containing heavy metals such as Cu, Zn, Ni and Mn and an alkali metal or an alkaline earth metal.

The reason why these ferrites (in particular, light metal ferrites) and magnetites are preferred is rooted not only in the problems of waste materials and environmental contamination that have grown vigorously in recent years, but in addition to these, those materials are preferred because they have an advantage of being capable of reducing a weight of the carrier 1 itself, so that the stress against the toner can be alleviated.

As the core material 2 particle, a resin-dispersed core in which a magnetic powder is dispersed in a binder resin as described above, can also be used. Examples of the magnetic powder include powders of iron, ferrites and magnetites, each having a volume medium diameter of about 0.1 to 3.0 μm. Examples of the binder resin include polyester-based resins, styrene-based resins, styrene-acrylic resins, acrylic resins, and phenolic resins.

A particle diameter of the core material 2 particle is, as the volume medium diameter (volume average primary particle diameter), in the range of 20 to 80 μm, and preferably in the range of 20 to 60 μm. The volume medium diameter of the core material 2 particle of 80 μm or less is preferable from the viewpoint that the image quality is not deteriorated, and an excellent image quality can be provided. The volume medium diameter of the core material 2 particle of 20 μm or greater is preferable from the viewpoint that the occurrence of carrier adhesion can be prevented, and an excellent image quality without carrier adhesion or fogging can be provided.

Regarding the magnetization characteristics of the core material 2 itself, saturation magnetization is preferably 20 $Am^2/kg$ to 80 $Am^2/kg$. The saturation magnetization of 20 $Am^2/kg$ or greater is preferable from the viewpoint that the occurrence of carrier adhesion can be prevented. The saturation magnetization of 80 $Am^2/kg$ or less preferable from the viewpoint that an excellent image quality can be provided without deteriorating an image quality.

The volume medium diameter of core material 2 particle is measured with a laser diffraction type particle size distribution analyzer, "HELOS" (manufactured by Sympatek GmbH), which is equipped with a wet dispersing system.

The saturation magnetization of core material 2 is measured with an automatic recording apparatus for direct current magnetization characteristics, "3257-35" (manufactured by Yokogawa Electric Co., Ltd.).

(Method for Producing Core Material 2)

Regarding a method for producing the core material 2, for example, an appropriate amount of raw materials is weighed, and then the raw materials are pulverized and mixed with a ball mill, a vibrating mill or the like for 0.5 hour or longer, and preferably for 1 to 20 hours. The pulverized product thus obtained is pelletized by using a press molding machine or the like, and then the pellets are preliminarily calcined at a temperature of 700 to 1200° C.

It is also acceptable to pulverize the raw materials without using a press molding machine, subsequently add the pulverized product with water to form a slurry and granulate the slurry by using a spray dryer. After the preliminary calcination, the resultant product is further pulverized with a ball mill, a vibrating mill or the like, and then water and optionally a dispersant, a binder and the like are added thereto. The viscosity is adjusted, and then the mixture is granulated. An oxygen concentration is controlled, the granules are maintained at a temperature of 1300° C. to 1500° C. for 1 to 24 hours, and subjected to main calcination. When pulverization is carried out after the preliminary calcination, water may be added, and pulverization may be carried out with a wet-type ball mill, a wet-type vibrating mill, or the like.

There are no particular limitations on the pulverizer such as the ball mill or vibrating mill described above. However, in order to disperse the raw materials effectively and uniformly, it is preferable to use fine particulate beads having a particle diameter of 1 mm or less as the medium to be used. Furthermore, a degree of pulverization can be controlled by adjusting a diameter of the beads used, a composition, and a pulverization time.

The calcined product thus obtained is pulverized and classified. Regarding the classification method, a particle diameter is adjusted to a desired particle diameter by using conventional methods such as air classification, mesh filtration, and sedimentation.

Thereafter, if necessary, the calcined product is subjected to oxide film treatment by heating the surface at a low temperature, to adjust electrical resistance. For the oxide film treatment, a heat treatment can be carried out, for example, at 300 to 700° C. by using a general rotary type electric furnace, a batch type electric furnace or the like. A thickness of the oxide film formed by this treatment is preferably 0.1 nm to 5 μm. If the thickness is less than 0.1 nm, the effect of the oxide film layer would be small. If the thickness is greater than 5 μm, magnetization would be deteriorated, or resistance would become excessively high, so that desired characteristics cannot be easily obtained, which is not preferable. Also, if necessary, reduction may also be carried out before the oxide film treatment.

(Constitution of Resin Layer (Coating Resin Layer) 3)

The resin layer (coating resin layer) 3 is composed of a vinyl polymer (resin for coating) having a unit of the following general formula (1):

General Formula (1)

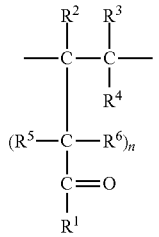

wherein $R^1$ represents an optionally substituted cycloalkyl group or an optionally substituted phenyl group; $R^2$ represents a hydrogen atom or a methyl group; $R^3$ and $R^4$ each represent a hydrogen atom; $R^5$ and $R^6$ each independently represent a hydrogen atom or an alkyl group; and n is an integer of 0 or greater.

(Type of Resin for Coating)

The resin for coating in the present invention is a vinyl polymer having a unit of the following general formula (1) which has an optionally substituted cycloalkyl group or an optionally substituted phenyl group:

General Formula (1)

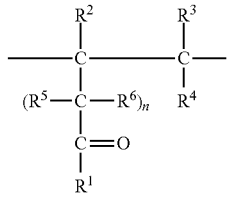

In the general formula (1), $R^1$ represents an optionally substituted cycloalkyl group or an optionally substituted phenyl group; $R^2$ represents a hydrogen atom or a methyl group; $R^3$ and $R^4$ each represent a hydrogen atom; $R^5$ and $R^6$ each independently represent a hydrogen atom or an alkyl group; and n is an integer of 0 or greater.

With regard to $R^1$ in the formula, the cycloalkyl group is preferably a cycloalkyl group having 3 to 10 carbon atoms, more preferably 3 to 7 carbon atoms, and particularly preferably 5 to 6 carbon atoms. When the cycloalkyl group or phenyl group described above is used, the vinyl polymer can have a highly bulky structure. The introduction of such a highly bulky structure near the ketone group (carbonyl group: —C(=O)—) is preferable from the viewpoint that hydrophobicity is further increased by steric hindrance, and the variation in an amount of electric charge due to environmental differences can be suppressed. Among others, $R^1$ is preferably an optionally substituted cycloalkyl group of 5 to 6 carbon atoms or an optionally substituted phenyl group.

The substituents that can be used to respectively substitute the cycloalkyl group and the phenyl group are not particularly limited as long as the substituents are a substituent that can effectively exhibit the effects by the present invention. Examples of the substituents include an alkyl group, a hydroxyl group, an amino group, a nitro group, a carbonyl group, an aryl group, an alkoxy group, and an arylalkyl group.

Among these substituents, preferred examples of the alkyl group include, but are not limited to, alkyl groups having 1 to 5 carbon atoms such as a methyl group, an ethyl group, a propyl group, an isopropyl group, a butyl group, an s-butyl group, a t-butyl group, an isobutyl group, an amyl group, an isoamyl group, and a t-amyl group. Alkyl groups having 1 to 4 carbon atoms are preferable.

Among the substituents, preferred examples of the alkoxy group include, but are not limited to, alkoxy groups having 1 to 5 carbon atoms such as a methoxy group, an ethoxy group, a propoxy group, an isopropoxy group, a butoxy group, an isobutoxy group, a t-butoxy group, a t-butyldimethylsilyloxy group, a pentyloxy group, an isopentyloxy group, a t-pentyloxy group, and a neopentyloxy group.

Among the substituents, preferred examples of the aryl group include, but are not limited to, aryl groups having 6 to 10 carbon atoms such as a phenyl group, a 1-naphthyl group, a 2-naphthyl group, an o-tolyl group, an m-tolyl group, a p-tolyl group, an o-xylyl group, a 3-isopropylphenyl group, a 4-isopropylphenyl group, a 4-butylphenyl group, a 4-isobutylphenyl group, a 4-t-butylphenyl group, a 2,3-diethylphenyl group, a 2,4-dimethylphenyl group, a 2,5-dimethylphenyl group, a 2,6-dimethylphenyl group, a 3,4-dimethylphenyl group, and a 3,5-dimethylphenyl group.

Among the substituents, preferred examples of the arylalkyl group include, but are not limited to, arylalkyl groups having 7 to 10 carbon atoms such as a phenylmethyl group (benzyl group), a phenethyl group, and a 2-phenylpropyl group.

Among these substituents, alkyl groups of 1 to 4 carbon atoms and alkoxy groups of 1 to 5 carbon atoms are preferable, and alkyl groups of 1 to 4 carbon atoms are more preferable. To be specific, $R^1$ is preferably a cyclohexyl group substituted with at least either of an alkyl group of 1 to 4 carbon atoms and an alkoxy group of 1 to 5 carbon atoms or a cyclohexyl group. $R^1$ is more preferably a cyclohexyl group substituted with an alkyl group of 1 to 4 carbon atoms or a cyclohexyl group.

$R^2$ in the formula is a hydrogen atom or a methyl group. Preferably, $R^2$ is a methyl group. This is because a glass transition point when $R^2$ is a methyl group increases by about 20° C. as compared the case where $R^2$ is a hydrogen atom, and thus fusion of a toner can be effectively prevented. Meanwhile, it is contemplated that as $R^2$, an alkyl group having two or more carbon atoms can also effectively prevent fusion of a toner.

$R^3$ and $R^4$ in the formula represent a hydrogen atom.

$R^5$ and $R^6$ in the formula each independently represent a hydrogen atom or an alkyl group; preferably a hydrogen atom or an alkyl group having 1 to 3 carbon atoms; more preferably a hydrogen atom or an alkyl group having 1 to 2 carbon atoms; even more preferably a hydrogen atom or a methyl group; and particularly preferably a hydrogen atom.

n in the formula is an integer of 0 or greater, preferably an integer from 0 to 5, more preferably an integer from 0 to 4, even more preferably an integer from 0 to 3, still more preferably an integer of 0 or 1, and particularly preferably 0.

(Polymerizable Monomer Composition)

The vinyl polymer according to the present invention can be formed by polymerization using a polymerizable monomer composition (composition for polymerization) containing a vinyl ketone monomer having an optionally substituted cycloalkyl group or an optionally substituted phenyl group. The polymerizable monomer composition (composition for polymerization) may be any composition containing a vinyl ketone monomer having a cycloalkyl group having an optionally substituted cycloalkyl group or an optionally substituted phenyl group.

(Vinyl Ketone Monomer)

The vinyl ketone monomer having an optionally substituted cycloalkyl group or an optionally substituted phenyl group, which is an essential component of the polymerizable monomer composition, is a monomer represented by the following general formula (3). The optionally substituted cycloalkyl group or phenyl group connects with a ketone group of vinyl ketone, and corresponds to $R^1$ in the following general formula (3).

General Formula (3)

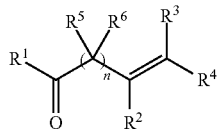

In the general formula (3), $R^1$ to $R^5$ are defined as in the general formula (1), and the explanation thereof is omitted.

As discussed above, the vinyl ketone monomer is preferably a vinyl ketone monomer of the general formula (3) wherein $R^1$ is an optionally substituted cycloalkyl group of 5 to 6 carbon atoms or an optionally substituted phenyl group, more preferably a vinyl ketone monomer of the general formula (3) wherein $R^1$ is a cyclohexyl group substituted with an alkyl group of 1 to 4 carbon atoms or an alkoxy group of 1 to 5 carbon atoms, a cyclohexyl group or a phenyl group, further more preferably a vinyl ketone monomer of the general formula (3) wherein $R^1$ is a cyclohexyl group substituted with an alkyl group of 1 to 4 carbon atoms or an alkoxy group of 1 to 5 carbon atoms or a cyclohexyl group, particularly preferably a vinyl ketone monomer of the general formula (3) wherein $R^1$ is an alkyl group of 1 to 4 carbon atoms or a cyclohexyl group.

Next, specific examples of the vinyl ketone monomer of the general formula (3) wherein $R^1$ is an optionally substituted cycloalkyl group, and a method for producing the vinyl ketone monomer will be described. Examples of such a vinyl ketone monomer include 1-cyclopropyl-2-methyl-2-propen-1-one, 1-cyclobutyl-2-methyl-2-propen-1-one, 1-cyclopentyl-2-methyl-2-propen-1-one, 1-cyclohexyl-2-methyl-2-propen-1-one, 1-cycloheptyl-2-methyl-2-propen-1-one, 1-adamantyl-2-methyl-2-propen-1-one, 1-cyclohexyl-3-methyl-3-buten-1-one, and 2-methyl-1-(2-methylcyclohexyl)-2-propen-1-one, but the vinyl ketone monomer is not intended to be limited to these. To be specific, the unit of the general formula (1) is preferably a structure of at least one vinyl polymerizable monomer selected from the group consisting of 1-cyclopropyl-2-methyl-2-propen-1-one, 1-cyclobutyl-2-methyl-2-propen-1-one, 1-cyclopentyl-2-methyl-2-propen-1-one, 1-cyclohexyl-2-methyl-2-propen-1-one, 1-cycloheptyl-2-methyl-2-propen-1-one, 1-adamantyl-2-methyl-2-propen-1-one, 1-cyclohexyl-3-methyl-3-buten-1-one, and 2-methyl-1-(2-methylcyclohexyl)-2-propen-1-one. In particular, 1-cyclohexyl-2-methyl-2-propen-1-one preferred. To be specific, the unit of the general formula (1) is particularly preferably a structure of 1-cyclohexyl-2-methyl-2-propen-1-one. The resin in the present invention may comprise a sole kind of the monomer (i.e., unit of the general formula (1)), or comprise two or more kinds of the monomers (i.e., units of the general formula (1)).

The method for synthesizing a vinyl ketone monomer having an optionally substituted cycloalkyl group (known compound) is not particularly limited, and any conventionally known synthesis method can be used. For illustrative purposes, a synthesis example for cyclohexyl vinyl ketone will be described below.

As for 1-cyclohexyl-2-propen-1-one (known compound), 1-cyclohexyl-2-methyl-2-propen-1-ol which is used as starting substance is subjected to Oppenauer oxidation with tripropoxyaluminum in acetone, to yield 1-cyclohexyl-2-propen-1-one.

Similarly, as for 1-cyclohexyl-2-methyl-2-propen-1-one, 1-cyclohexyl-2-methyl-2-propen-1-ol is subjected to Oppenauer oxidation with tripropoxyaluminum in acetone, to yield 1-cyclohexyl-2-methyl-2-propen-1-one.

Alternatively, 1-cyclohexyl-2-methyl-2-propen-1-one can be obtained by using cyclohexyl ethyl ketone as a starting substance, producing cyclohexyl 2-N-diaminomethylethyl ketone by using an Eschenmoser reagent, and then converting the 2-N-diaminomethyl group to a methylene group through oxidation reaction.

Next, specific examples of the vinyl ketone monomer having an optionally substituted phenyl group, and a method for producing the vinyl ketone monomer will be described.

Examples of the vinyl ketone monomer having a phenyl group include 2-methyl-1-phenyl-2-propen-1-one, 3-methyl-1-phenyl-3-buten-1-one, and 2-methyl-1-tolyl-2-propen-1-one, but the vinyl ketone monomer is not intended to be limited to these. To be specific, the unit of the general formula (1) is preferably a structure of at least one vinyl polymerizable monomer selected from the group consisting of 2-methyl-1-phenyl-2-propen-1-one, 3-methyl-1-phenyl-3-buten-1-one, and 2-methyl-1-tolyl-2-propen-1-one.

There are no particular limitations on the synthesis method for the vinyl ketone monomer having an optionally substituted phenyl group (known compound), and any conventionally known synthesis method can be used. For illustrative purposes, a synthesis example for phenyl vinyl ketone will be described below.

As an example of the synthesis of phenyl vinyl ketone, phenyl vinyl ketone can be obtained by conducting Friedel-Crafts reaction between an aromatic compound and a halogenated alkylene in the presence of a catalyst such as aluminum chloride.

The polymerizable monomer composition includes a structure of the general formula (1) as an essential component, which is preferably used in the form as a homopolymer. To be specific, the vinyl polymer is a homopolymer of the unit of the general formula (1). Another monomer component can be added to an extent that the effects by the present invention can be attained effectively.

Specifically, the polymerizable monomer composition may use one kind or two or more kinds of (a) a vinyl ketone monomer having an optionally substituted cycloalkyl group. Thereby, a resin for coating based on a homopolymer or a copolymer of the relevant monomer (one kind or two or more kinds) can be obtained. It is also acceptable to use one kind or two or more kinds of (b) a vinyl ketone monomer having an optionally substituted phenyl group. Thereby, a resin for coating based on a homopolymer or a copolymer of the relevant monomer (one kind or two or more kinds) can be obtained. It is also acceptable to use (c) a polymerizable monomer composition including a vinyl ketone monomer (one kind or two or more kinds) having an optionally substituted cycloalkyl group and a vinyl ketone monomer (one kind or two or more kinds) having an optionally substituted phenyl group. Thereby, a resin for coating based on a copolymer of these monomers can be obtained. It is also acceptable to use (d) a polymerizable monomer composition including a vinyl ketone monomer defined in any one of (a) to (c) as above (one kind, or two or more kinds) and another polymerizable monomer (one kind or two or more kinds). Thereby, a resin for coating based on a copolymer of these monomers (copolymer resin) can be obtained.

The other polymerizable monomer defined in (d) is not particularly limited as long as the effects by the present invention can be attained effectively, and examples thereof include polymerizable monomers such as vinyl-based monomers. Examples of the vinyl-based monomer include styrene-based, acrylic acid-based, methacrylic acid-based, alkyl acrylate-based, and alkyl methacrylate-based polymerizable monomers.

Specific examples thereof include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; chain or cyclic (including alicyclic) methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, benzyl methacrylate, isobornyl methacrylate, diethylaminoethyl methacrylate, dimethylaminoethyl methacrylate, dicyclopentanyl methacrylate, cyclohexyl methacrylate, methylcyclohexyl methacrylate, trimethylcyclohexyl methacrylate, t-butylcyclohexyl methacrylate, cyclohexylphenyl methacrylate, cyclododecyl methacrylate, and adamantyl methacrylate; chain or cyclic (including alicyclic) acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, benzyl acrylate, isobornyl acrylate, dicyclopentanyl acrylate, cyclohexyl acrylate, methylcyclohexyl acrylate, trimethylcyclohexyl acrylate, t-butylcyclohexyl acrylate, cyclohexylphenyl acrylate, cyclododecyl acrylate, and adamantyl acrylate; olefins such as ethylene, propylene, and isobutylene; halogen-based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyrridine; acrylic acid or methacrylic acid derivatives such as acrylonitrile, methacrylonitrile, and acrylamide. These vinyl-based polymerizable monomers can also be used singly or in combination.

Even among these other polymerizable monomers, chain methacrylic acid ester (derivative) monomers, and alicyclic methacrylic acid ester monomers are preferred, and from the viewpoint that chargeability or wear properties are significantly improved, chain methacrylic acid ester monomers are more preferred, while from the viewpoint of suppressing decrease in a glass transition point, methyl methacrylate (MMA) is particularly preferred. Therefore, the polymerizable monomer composition of the item (d) is a composition including (composed of) a vinyl ketone monomer and a chain methacrylic acid ester (derivative) monomer, or a composition including (composed of) a vinyl ketone monomer and an alicyclic methacrylic acid ester monomer, and particularly, a composition including (composed of) a chain methacrylic acid ester (derivative) monomer is preferred.

To be specific, the resin (vinyl polymer) in the present invention is preferably a copolymer having the unit of the general formula (1) and a unit of the following general formula (2):

General Formula (2)

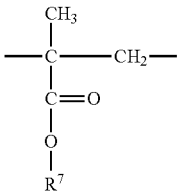

In the general formula (2), $R^7$ represents an alkyl group or a cycloalkyl group. Preferred examples of the alkyl group includes, but are not limited to, alkyl groups having 1 to 5 carbon atoms such as a methyl group, an ethyl group, a propyl group, an isopropyl group, a butyl group, an s-butyl group, a t-butyl group, an isobutyl group, an amyl group, an isoamyl group, and a t-amyl group. Alkyl groups having 1 to 4 carbon atoms are preferable. For the cycloalkyl group, there are no particular limitations, but preferred examples thereof include cycloalkyl groups having 3 to 10 carbon atoms, more preferably 3 to 7 carbon atoms, and particularly preferably 5 to 6 carbon atoms.

The chain methacrylic acid ester monomer is preferable from the viewpoint that chargeability and friction properties (effect of suppressing release of a coating layer from a core material) are significantly improved. There are no particular limitations on such a chain methacrylic acid ester monomer, and examples thereof include, but are not limited to, monomers such as methyl methacrylate (MMA), ethyl methacrylate, propyl methacrylate, n-butyl methacrylate, pentyl methacrylate, hexyl methacrylate, octyl methacrylate, and 2-ethylhexyl methacrylate. The chain methacrylic acid ester monomers having an alkyl group of 1 to 6 carbon atoms are particularly preferable from the viewpoint of effect of improving friction properties by the resin for coating (copolymer resin).

A cycloalkyl methacrylate, which is an alicyclic methacrylic acid ester monomer, is preferable in view of excellent frictional chargeability and moisture resistance when used in a resin for coating (copolymer resin). There are no particular limitations on such a cycloalkyl methacrylate, and examples thereof include, but are not limited to, monomers such as cyclopropyl methacrylate, cyclobutyl methacrylate, cyclopentyl methacrylate, cyclohexyl methacrylate (CHMA), and cyclooctyl methacrylate. The cycloalkyl methacrylate having a cycloalkyl group of 3 to 6 carbon atoms are particularly preferable from the viewpoint of effect of improving frictional chargeability and moisture resistance by the resin for coating (copolymer resin).

In regard to the polymerizable monomer composition in (d), a weight ratio of a vinyl ketone monomer as an essential polymerizable monomer component and another polymerizable monomer used in combination at the time of forming the copolymer resin (=copolymerization ratio; vinyl ketone monomer (parts by weight)/another polymerizable monomer (parts by weight) is 10/90 to 90/10, preferably 30/70 to 80/20, more preferably 40/60 to 80/20, and particularly preferably 50/50 to 80/20. When the weight ratio (copolymerization ratio) is in the range described above, the difference between the amounts of electric charge (difference between the amount of electric charge at normal temperature and normal humidity, and the electric charge at high temperature and high humidity) of the two-component developer thus obtainable can be adjusted to 10 μC/g or less, which is preferable from the viewpoint that satisfactory results, that is, an effect of enhancing environmental stability of carrier charging performance which induces suppression of environmental difference in charging, can be obtained (see Examples 1 to 6 and 8). However, even in the case where the difference in the amount of electric charge deviates from the range described above, the polymerizable monomer composition may be included in the technical scope of the present invention as long as the effects described above are not impaired. For example, when only vinyl ketone monomer (one kind or two or more kinds) in the (a) to (c) is used as an essential polymerizable monomer component, that is, even in the case where the weight ratio (copolymerization ratio; vinyl ketone monomer (parts by weight)/another polymerizable monomer (parts by weight)) is 100/0, the difference in the amount of electric charge of the two-component developer thus obtainable (difference between the amount of electric charge at normal temperature and normal humidity and the amount of electric charge at high temperature and high humidity) can be adjusted to 10 μC/g or less, and satisfactory result (effect of enhancing environmental stability of carrier charging performance which induces suppression of environmental difference in charging), may be obtained (see Example 7). From this point of view, if the weight ratio (copolymerization ratio; vinyl ketone monomer (parts by weight)/another polymerizable monomer (parts by weight)) is in the range of 10/90 to 100/0, the effect can be sufficiently manifested. However, combined use of a vinyl ketone monomer and another polymerizable monomer is preferable from the viewpoint that effect of preventing release of a coating rein layer from a core material after image is formed over a long period, or effect of suppressing decrease in an amount of electric charge due to contamination by external additives, can enhanced.

As the polymerizable monomer composition in the (d), preferably selected is a polymerizable monomer composition which comprises a vinyl ketone monomer as an essential polymerizable monomer component and a chain methacrylic acid ester monomer as another polymerizable monomer component which has a large amount of electric charge (chargeability) and excellent wear properties. In this case, when a vinyl ketone monomer and a chain methacrylic acid ester monomer are used in combination for the formation of the copolymer resin, a weight ratio (=copolymerization ratio; vinyl ketone monomer (parts by weight)/chain methacrylic acid ester monomer (parts by weight)) is 10/90 to 90/10, preferably 30/70 to 80/20, more preferably 40/60 to 80/20, and particularly preferably 50/50 to 80/20. When the weight ratio (copolymerization ratio) is in the range described above, the difference between the amounts of electric charge (difference between the amount of electric charge at normal temperature and normal humidity, and the electric charge at high temperature and high humidity) of the two-component developer thus obtainable can be adjusted to 10 μC/g or less, which is preferable from the viewpoint that satisfactory results, that is, an effect of enhancing environmental stability of carrier charging performance which induces suppression of environmental difference in charging, can be obtained (see Examples 1 to 6). However, even in the case where it deviates from the range described above, the weight ratio may be included in the technical scope of the present invention as long as the effects described above are not impaired. For example, since the effect can be obtained even in the case where the weight ratio (copolymerization ratio; vinyl ketone monomer (parts by weight)/another polymerizable monomer (parts by weight)) is 100/0, the effect can be sufficiently exhibited when the weight ratio (copolymerization ratio; vinyl ketone monomer (parts by weight)/another polymerizable monomer (parts by weight)) is in the range of 10/90 to 100/0. However, combined use of a vinyl ketone monomer and chain methacrylic acid ester monomer is preferable from the viewpoint that effect of preventing release of a coating resin layer from a core material after image is formed over a long period, or effect of suppressing decrease in an amount of electric charge due to contamination by external additives, can further enhanced.

(Weight Average Molecular Weight of Resin for Coating)

A weight average molecular weight of the resin for coating (polymer obtained by polymerizing the polymerizable monomer composition) that constitutes the coating resin layer 3 is not particularly limited as long as the effects by the present invention can be effectively attained. The weight average molecular weight is preferably 200,000 or greater and 800,000 or less (200,000 to 800,000), more preferably in the range of 250,000 to 700,000, and further more preferably in the range of 400,000 to 600,000. The weight average molecular weight of the resin for coating of 200,000 or greater is preferable from the viewpoint that the shrinkage of the coating resin layer 3 that is constituted of the resin for coating would not excessively accelerated, and carrier adhesion would occur with difficulties. When the weight average molecular weight of the resin for coating is 800,000 or less, a satisfactory amount of electric charge can be maintained for a long period without causing decrease in an amount of electric charge due to the migration of an external additive from a toner to a carrier surface (surface of the coating resin layer 3). A glass transition point of the resin for coating that constitutes the coating resin layer 3 is not particularly limited as long as the weight average molecular weight is in the range as described above, but the glass transition point is preferably in the range of 60 to 150° C. When the glass transition point, is in the range as described above, a dense coating resin layer 3 having satisfactory film-forming properties can be formed.

The weight average molecular weight is measured by gel permeation chromatography (GPC) according to the method described below.

"HLC-8220GPC" (manufactured by Tosoh Corp.) as the apparatus, and "TSK guard column Super HZ-L and TSK GEL SUPER HZM-M3 series" (manufactured by Tosoh Corp.) as columns are used, and while the column temperature is maintained at 40° C., tetrahydrofuran (THF) as a carrier solvent is allowed to flow at a flow rate of 0.35 ml/min. A measurement sample is dissolved in tetrahydrofuran so as to give a concentration of 1 mg/ml by treating the measurement sample using an ultrasonic dispersing machine for 5 minutes at room temperature. Subsequently, a sample solution is obtained by treating the solution with a membrane filter having a pore size of 0.2 μm. 10 μL of this sample solution is injected into the apparatus together with the carrier solvent, and detected by using a refractive index detector (RI detector). The weight average molecular weight distribution of the measurement sample is calculated by using a calibration curve measured by using monodispersing polystyrene standard particles. Regarding the polystyrene for the measurement of a calibration curve, ten samples are used.

(Particle Diameter of Particles of Resin for Coating)

The coating resin layer 3 can be formed by, for example, polymerizing the polymerizable monomer composition by a conventionally known polymerization method such as an emulsion polymerization method to yield particles of a resin for coating, and attaching the particles of the resin for coating in a layer form to the surface of the a core material 2 particle by, for example, a coating method utilizing mechanical impact force. A volume average particle diameter of such particles of the resin for coating is preferably 60 to 300 nm, and more preferably 80 to 250 nm. The use of the particles of resin for coating having a volume average particle diameter in this range is preferable because a surface of core material 2 particle having a small diameter can be satisfactorily coated therewith. Furthermore, the fluctuation coefficient in the volume-based particle size distribution is preferably 20% or less. The fluctuation coefficient of 20% or less is preferable from the viewpoint that an excellent image quality can be provided without decrease in image quality.

As used herein, the fluctuation coefficient of volume-based particle size distribution is a value defined as follows.

(Volume-Based Particle Size Distribution)

The volume average particle size (Mv) is measured by using a dynamic light scattering type particle size analyzer "MICROTRAC UPA-150 (manufactured by Nikkiso Co., Ltd.)" under the following measurement conditions.

Sample refractive index: 1.59

Sample specific gravity: 1.05

Solvent refractive index: 1.33

Solvent viscosity: 0.797 (30° C.), 1.002 (20° C.)

Zero-point adjustment: The sample for zero-point adjustment is prepared by introducing ion-exchanged water into a measurement cell.

Concentration adjustment: The concentration is adjusted so as to give a concentration in the range of 0.9 to 1.1.

The fluctuation coefficient in the volume-based particle size distribution is calculated from the following Equation (1) by using a standard deviation (Sd) measured with a dynamic light scattering type particle size analyzer MICROTRAC UPA-150.

$$\text{Fluctuation coefficient}=(Sd/Mv)\times 100 \qquad \text{[Equation (1)]}$$

In a resin for coating that constitutes a coating resin layer 3 (or a composition for polymerization containing a polymerizable monomer composition for forming a resin for coating), a charge control agent can be incorporated for the purpose of controlling resistance or an amount of electric charge of a carrier, and a rate of charging. Examples of the charge control agent include electroconductive carbon; oxides such as titanium oxide and tin oxide; and various organic conductive agents. Other examples include various charge control agents that have been generally used for toner, and various silane coupling agents. There are no particular limitations on the type of the charge control agent or coupling agent that can be used, but preferred examples thereof include charge control agents such as nigrosin-based dyes, organometallic complexes, and metal-containing monoazo dyes; aminosilane coupling agents, and fluorine-based silane coupling agents. Furthermore, there are also no particular limitations on a content of the charge control agent and coupling agent, to an extent that effects by the present invention are not impaired, and also to an extent that the purpose of adding the charge control agent or coupling agent can be achieved.

(Amount of Resin for Coating)

An amount of the resin for coating (coating resin) that constitutes the coating resin layer 3 is in the range of 1.0 to 4.5% by weight, and preferably in the range of 3 to 3.5% by weight, relative to the amount of the core material 2 (core material 2 particle). The amount of the resin for coating (coating resin) of the coating resin layer 3 coated on the core material 2 of 1.0% by weight or greater relative to the amount of the core material 2 is advantageous from the viewpoint that the intended durability performance (performance in which carrier adhesion or fogging does not occur even in the case of performing printing of a predetermined number of sheets, which indicates durability enhancement) can be realized. The amount of the resin for coating (coating resin) of the coating resin layer 3 coated on the core material 2 of 4.5% by weight or less relative to the amount of the core material 2 is advantageous from the viewpoint that by increasing an amount of the resin for coating (coating resin), resistance can be increased, and the occurrence of carrier adhesion can be prevented. The amount of the resin for coating (coating resin) that constitutes the coating resin layer 3 can be obtained, for example, by mixing the carrier 1 with methyl ethyl ketone (MEK), dissolving and removing the resin for coating (coating resin), measuring the carrier weight after dissolution, and subtracting the carrier weight after dissolution from the initial carrier weight.

(Method for Detecting Resin for Coating)

A method for detecting a resin for coating that constitutes a coating resin layer 3 of a carrier 1 is not particularly limited, and for example, a resin for coating can be detected (analyzed) simply by pyrolysis gas chromatography (PGC) or the like.

(Method for Producing Particles of Resin for Coating)

There are no particular limitations on a method for producing particles of the resin for coating as described above, and any conventionally known polymerization method can be appropriately used. Examples of the polymerization method include a pulverization method, an emulsion dispersion method, a suspension polymerization method, a solution polymerization method, a dispersion polymerization method, an emulsion polymerization method, an emulsion polymerization aggregation method, and other known methods. In particular, since the formation of fine dust is suppressed, and particles having a small particle diameter can be easily obtained, particles synthesized by a polymerization aggregation method or an emulsion polymerization method are preferred from the viewpoints of particle diameter, particle size distribution, and molecular weight. Particularly, in relation to the molecular weight, usually the weight average molecular weight needs to be 200,000 or greater (if the weight average molecular weight is less than 200,000, wear occurs vigorously), and these polymerization methods are preferred from the viewpoint that a large molecular weight can be easily obtained, and a resin having a weight average molecular weight of up to 800,000 can be produced. In addition, even for the problem that as a surfactant remains in the resin after polymerization, the resin for coating acquires water retentivity, which problem has been considered as a demerit of these polymerization methods, the present invention is preferred from the viewpoint that by carrying out polymerization of a polymerizable monomer composition including a vinyl ketone monomer having an optionally substituted cycloalkyl group or an optionally substituted phenyl group, the problem of water retentivity can also be addressed.

There are also no particular limitations on the components of the composition for polymerization such as a polymerization initiator, a surfactant, and a chain transfer agent that is optionally used, in addition to the polymerizable monomer composition that is used in such an emulsion polymerization method or an emulsion polymerization aggregation method, and also on the polymerization conditions such as the polymerization temperature, and conventionally known components of a composition for polymerization, such as a polymerization initiator, a surfactant and a chain transfer agent, can be used. The polymerization conditions such as the polymerization temperature can also be adjusted by appropriately using conventionally known polymerization conditions. Specifically, it is preferable to perform emulsion polymerization using the various additives described in section "Production of resin for coating 1" in the Examples that will be described below. That is, it is preferable to perform emulsion polymerization of a polymerizable monomer composition by using sodium dodecyl sulfate as an anionic surfactant, water (ion-exchanged water) as a solvent, and potassium persulfate (KPS) as a polymerization initiator, respectively.

Meanwhile, the weight average molecular weight and particle diameter of the resin for coating as described above can be adjusted at the time of polymerization, for example, by means of a polymerization initiator, surfactant, chain transfer agent, polymerization temperature and the like used in the emulsion polymerization method or emulsion polymerization aggregation method.

However, in the present invention, a method for producing particles of the resin for coating is not limited to the pulverization method, emulsion dispersion method, suspension polymerization method, dispersion polymerization method, emulsion polymerization method, and emulsion polymerization aggregation method described above, and for example, products synthesized by other polymerization methods such as mini-emulsion polymerization method as other known methods, can also be used. A resin synthesized by a mini-emulsion polymerization method is also preferred in view of the particle diameter, particle size distribution, and molecular weight. The mini-emulsion polymerization method is a method for producing particles of a resin for coating by dispersing one kind or two or more kinds of polymerizable monomers that constitute the polymerizable monomer composition as described above in an aqueous medium containing a surfactant, and polymerizing the dispersed particles of the polymerizable monomers (one kind or two or more kinds) in the dispersed state. Herein, a diameter of the dispersed particle of the polymerizable monomer is about 60 to 300 nm. When the diameter of the dispersed particle of the polymerizable monomer is in the range described above, the volume average particle diameter of the particles of the resin for coating thus obtainable can be adjusted to the range of 60 to 300 nm as described above, and it is preferable from the viewpoint that surface of core material 2 particle having a small diameter can be satisfactorily coated therewith.

In a specific method for producing particles of a resin for coating according to the mini-emulsion polymerization method, for example, one kind or two or more kinds of the polymerizable monomers that constitute the polymerizable monomer composition are added to water containing a surfactant, the mixture is subjected to shear by using, for example, a dispersing machine such as CLEARMIX, to prepare an emulsion of polymerizable monomers. Subsequently, a polymerization initiator is added to this emulsion, and the polymerizable monomers are subjected to a polymerization reaction to obtain particles of a resin for coating. The particle size distribution of the particles of the resin for coating can be managed by controlling an emulsion particle size distribution. The emulsion particle size distribution can be adjusted by dispersion conditions of a dispersing machine. In the case of CLEARMIX, the emulsion particle size distribution can be adjusted by a rotation speed and a dispersing time.

(Production of Carrier 1)

Specific production methods for forming a carrier 1 having a coating resin layer 3 in which a surface of a core material 2 particle (magnetic particles) is coated with a resin for coating, include was coating method and dry coating method. The respective methods will be described in detail below.

The wet coating method includes:

(1) Fluidized Bed Type Spray Coating Method a method which comprises spray coating a surface of magnetic particles (core material 2 particle) with a coating liquid prepared by dissolving a resin for coating in a solvent by using a fluidized bed, subsequently drying the magnetic particles to form a coating resin layer 3, and thereby producing a carrier 1 (particles) having a coating resin layer 3 in which the surface of the core material 2 is coated with the resin for coating;

(2) Immersion Type Coating Method a method which comprises coating magnetic particles (core material 2 particles) by immersing the magnet particles in a coating liquid prepared by dissolving a resin for coating in a solvent, subsequently drying the magnetic particles to form a coating resin layer 3, and thereby producing a carrier 1 (particles) having a coating resin layer 3 in which the surface of the core material 2 particle is coated with a resin for coating;

(3) Polymerization Method a method which comprises coating magnetic particles (core material 2 particle) by immersing the magnetic particles in a coating liquid prepared by dissolving a reactive compound for forming a resin for coating (including a polymerization initiator and the like, in addition to a polymerizable monomer composition for synthesizing a resin for coating) in a solvent, subsequently performing a polymerization reaction by applying heat or the like, to form a coating resin layer 3, and thereby producing a carrier 1 (particles) having a coating resin layer 3 in which the surface of the a core material 2 particle is coated with a resin for coating; and the like.

The dry coating method includes:

(1) a method which comprises depositing ng particles of a resin for coating on a surface of magnetic particles (core material 2 particles) to be coated, subsequently applying mechanical impact force thereto, melting or softening the particles of the resin for coating (particles of the resin for coating as described above) deposited on the surface of the magnetic particles (core material 2 particles) to be coated so as to fix the particles for the resin for coating thereon, to form a coating resin layer 3, and thereby producing a carrier 1 (particles) having a coating resin layer 3 in which the surface of the core material 2 particle is coated with the resin for coating; and the like.

Specifically, in the dry coating method in the (1), a method (mode) which comprises subjecting magnetic particles (core material 2 particles) and particles of a resin for coating to high-speed stirring by using a high-speed stirring mixer which can exert mechanical impact force under no heating or under heating, repeatedly exerting impact force to the mixture, melting or softening the particles of the resin for coating to fix the particles onto the surface of the magnetic particles to form a coating resin layer 3, and thereby producing a carrier 1 (particles) having a coating resin layer 3 in which the surface of the core material 2 particle is coated with a resin for coating, can be used. In the case of heating the particles, the temperature is preferably 60 to 130° C. It is because if the heating temperature is excessively high, aggregation between the particles of the carrier 1 is likely to occur. That is, when the particles are heated to a temperature in the range described above, aggregation between the particles of the carrier 1 does not occur, and a coating resin layer 3 in the form of a uniform layer can be formed by fixing the particles of the resin for coating onto the surface of the core material 2 particle.

Regarding a method for forming a carrier 1 having a coating resin layer 3 in which the surface of the a core material 2 particle (magnetic particles) is coated with a resin for coating on the surface of the core material 2 particle according to the present invention, it is most preferable to carry out the formation by the current system (system of the dry coating method as described above). The current system (system of the dry coating method) is composed of at least the following processes.

The method consists of:

Process 1: a process of mixing (mechanically stirring) a member prepared by blending appropriate amounts of the a core material 2 particle on which a coating resin layer 3 is intended to be formed, a resin for coating, and an additive (added as necessary) at room temperature, and attaching the particles of the resin for coating and the optionally added additive to the surfaces of the individual core material 2 particle in the form of a uniforms layer;

Process 2: after the Process 1, a process of applying mechanical impact or heat to the particles to melt or soften the particles of the resin for coating adhering to the surface of the core material 2 particle to fix the particles of the resin for coating thereon, and thereby forming a coating resin layer 3; and Process 3: after the Process 2, a process of cooling the product to room temperature.

Furthermore, if necessary, Processes 1 through 3 can be repeated several times, and a coating resin layer 3 having a desired thickness can be formed.

An amount of the particles of the resin for coating that is incorporated in the Process 1 is preferably from 1 to 7 parts by weight relative to 100 parts by weight of the core material 2 particle. The amount of the particles of the resin for coating of 1 part or greater relative to 100 parts by weight of the core material 2 particle is preferable from the viewpoint that the core material 2 particle can be completely coated with the resin particles. Furthermore, the amount of the particles of the resin for coating of 7 parts by weight or less relative to 100 parts by weight of the core material 2 particle is preferable from the viewpoint that the generation of aggregated particles can be suppressed, and a uniform resin particle coating layer can be formed on the core material 2 particle.

In regard to the Process 2, it is preferable to employ a process of applying mechanical impact force to the system while the core material 2 particle having the particles of the resin for coating attached thereto are heated to a temperature equal to or higher than a glass transition point of the resin for coating, spreading the resin for coating over the surface of the core material 2 particle to fix and coat the resin for coating, and thereby forming a coating resin layer 3.

Examples of the apparatus to apply mechanical impact or heat in the Process 2 include a pulverizer having a rotor and a liner, such as a turbo mill, a pin mill or a Kryptron, and a high-speed stirring mixer equipped with a stirring blade.

Among these, a high-speed stirring mixer equipped with a stirring blade is preferred since a coating resin layer 3 can be satisfactorily formed.

The time for applying mechanical impact or heat in the Process 2 may be varied with the apparatus, but the time is usually 10 to 60 minutes. When mechanical impact or heat is applied for a time period in the range described above, aggregation between the particles of the carrier 1 does not occur, the particles of the resin for coating are fixed onto the surface of the core material 2 particle, and thus a coating resin layer 3 can be formed.

The intensity of the mechanical impact force used in the Process 2 is, in terms of the circumferential velocity, usually 3 to 20 m/sec, and preferably 4 to 15 m/sec. When the circumferential velocity is 3 m/sec or greater, the particles of the resin for coating can be satisfactorily fixed onto the surface of the core material 2 particle without causing; blocking, to form a coating resin layer 3. Furthermore, when the circumferential velocity is 15 m/sec or less, the particles of the resin for coating can be fixed onto the surface of the core material 2 particle without causing destruction of the coating resin layer 3, or destruction of the core material 2 particle themselves that constitute the carrier 1, to form a coating resin layer 3.

In the case of performing heating in the Process 2, the heating temperature is preferably in the range of temperatures higher by 5° C. to 20° C. than a glass transition point of a resin for coating, and specifically, the heating temperature is preferably in the range of 60 to 130° C. When heating is carried out to a temperature in the range described above, aggregation between the particles of the carrier 1 does not occur, the particles of the resin for coating can be fixed onto the surface of the core material 2 particle, to form a coating resin layer 3 in the form of a uniform layer.

In the current system (system of the dry coating method), since an organic solvent and the like are not used, not only the coating resin layer 3 is dense and firm without any holes formed by solvent evaporation, but also particles of the carrier 1 having a coating resin layer 3 with satisfactory adhesiveness to the core material 2 particle the can be produced.

(Thickness of Coating Resin Layer 3)

A thickness of the coating resin layer 3 of 1 μm or greater is preferable from the viewpoint that the intended durability performance (performance in which even in the case of performing printing of a predetermined number of sheets, carrier adhesion or fogging does not occur, which indicates durability enhancement) can be realized. The thickness of the coating resin layer 3 of 4 μm or less is preferable from the viewpoint, that resistance increases as the amount of the resin for coating (coating resin) is increased, and thus the occurrence of carrier adhesion can be prevented.

The thickness of the coating resin layer 3 can be determined by the method described below.

A measurement sample is produced by cutting a carrier along a plane that passes through the center of the carrier with a focused ion beam sample preparation apparatus, "SMI2050" (manufactured by SII Nanotechnology, Inc.), and the measurement sample is observed with a transmission electron microscope "JEM-2010F" (manufactured by JEOL, Ltd.), in a field of vision at a magnification of 5000 times. The mean value of an area with the largest thickness and an area with the smallest thickness in that field of vision is designated as the thickness of the resin coating layer. Meanwhile, measurements are taken at 50 sites, and if the number of measurement is insufficient in a single field of vision in a photograph, the number of fields of vision is increased until the number of measurement of 50 is fulfilled.

Figure 2:
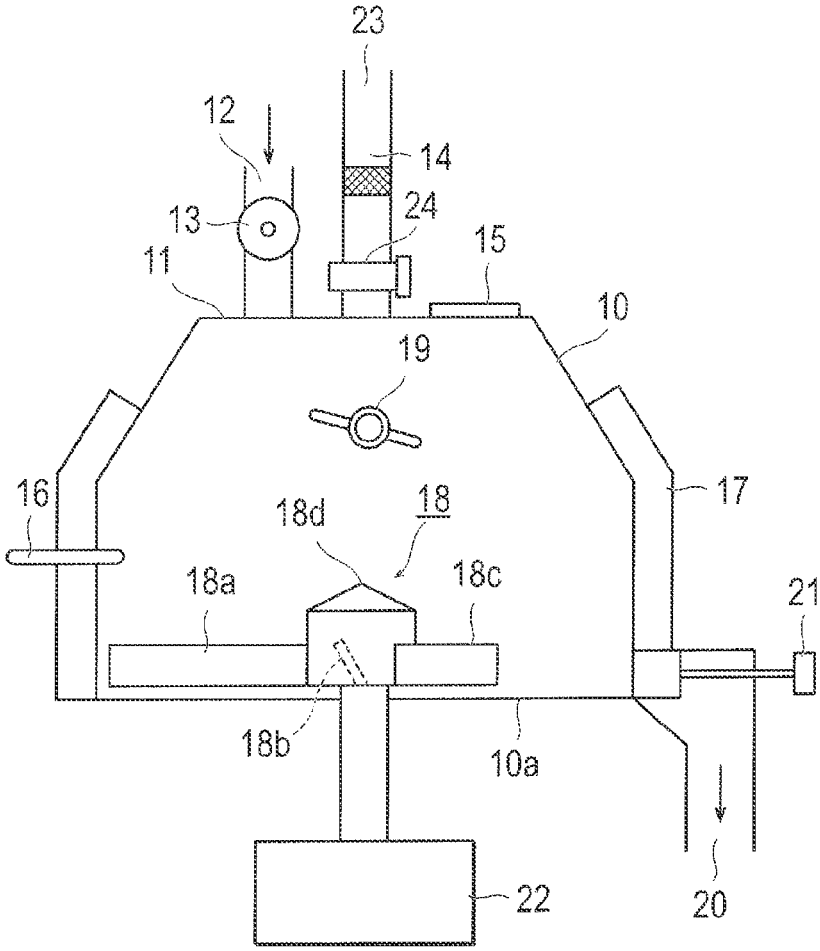
FIG. 2 is a schematic diagram illustrating an example of a high-speed stirring mixer equipped with a stirring blade that is used in the production of a carrier having a coating resin layer, in which the surface of core material particle is coated with a resin for coating. In the FIG. 2, reference numeral 10 represents a main body container; reference numeral 10*a* represents a bottom of main body container; reference numeral 11 represents an upper lid of main body; reference numeral 12 represents a raw material feed port; reference numeral 13 represents a feed valve; reference numeral 14 represents a filter; reference numeral 15 represents an access port; reference numeral 16 represents a thermometer; reference numeral 17 represents a jacket for temperature regulation; reference numeral 18 represents a horizontally rotating body; reference numeral 18*a*, 18*b*, 18*c* represent a stirring blade; reference numeral 18*d* represents a center of rotating body; reference numeral 19 represents a horizontally rotating body; reference numeral 20 represents a product outlet; reference numeral 21, 24 represent a discharge valve; reference numeral 22 represents a motor; and reference numeral 23 represents an exhaust vent in container.

FIG. 2 is a schematic diagram illustrating an example of a high-speed stirring mixer equipped with a stirring blade which is suitable as an apparatus for applying mechanical impact or heat in Process 2 in the method for forming a coating resin layer 3 as described above. Hereinafter, the system according to a mechanical impact method used in the present invention (system of the dry coating method as described above) will be described in detail with reference to FIG. 2.

In FIG. 2, reference numeral 11 represents an upper lid of a main body, and provided on the upper lid 11 are a raw material feed port 12, a feed valve 13, a filter 14, and an access port 15. Predetermined amount of a core material 2 particle and particles of a resin for coating are fed through the raw material feed port 12, and the raw materials thus fed are stirred by a horizontally rotating body 18 that is driven by a motor 22. The rotating body 18 comprises stirring blades 18*a*, 18*b* and 18*c* that are disposed at an angle interval of 120° from each other joined at the center 18*d*, and these blades are mounted at an inclination of about 35° with respect to the plane of the bottom 10*a*. Accordingly, when the stirring blades 18*a*, 18*b* and 18*c* are rotated at a high speed, the raw materials are brushed upward, collide with the inner walls in the upper part of the main body container 10, and fall down; in the middle of the course, the raw materials collide with a horizontally rotating body 19, causing acceleration of the stirring of the raw materials and cracking of aggregates. Meanwhile, reference numeral 17 represents a jacket for temperature regulation; reference numeral 16 represents a thermometer; reference numeral 20 represents a product outlet; reference numerals 21 and 24 represent a discharge valve; and reference numeral 23 represents an exhaust vent in container.

(Toner)

Regarding the toner used in the two-component developer of the present invention, any toner that has been conventionally frequently used can be used without particular limitations, but a toner obtained by mixing parent toner particles with an external additive is preferred.

(Parent Toner Particles)

The parent toner particles preferably contain a resin (toner resin), a colorant, and a mold releasing agent. For example, a styrene-acrylic resin or a polyester-based resin can be used as the toner resin, and also, conventionally used colorants can be used as the colorant, while if necessary, a mold releasing agent or a charge control agent is added.

(Method for Producing Parent Toner Particles)

A method for producing parent toner particles is not particularly limited, and examples of the method include a pulverization method, an emulsion dispersion method, a suspension polymerization method, a dispersion polymerization method, an emulsion polymerization method, an emulsion polymerization aggregation method, and other known methods. Particularly, from the viewpoint that the formation of fine dust is suppressed, and particles having a small diameter can be easily obtained, it is preferable to use parent toner particles that are obtained by an emulsion polymerization aggregation method.

(Toner Resin)

When the parent toner particles are produced by a pulverization method, an emulsion dispersion method or the like, examples of the toner resin that can be used to constitute the parent toner particles include various conventionally-known resins, such as styrene-based resins, (meth)acrylic resins, styrene-(meth)acrylic copolymer resins, vinyl-based resins such as olefinic resins, polyester-based resins, polyamide-based resins, polycarbonate resins, polyethers, polyvinyl acetate-based resins, polysulfone, epoxy resins, polyurethane resins, and urea resins. Among these, the toner preferably contains styrene-acrylic copolymer resin or polyester-based resin. These can be used singly, or two or more kinds can be used in combination.

On the other hand, when the parent toner particles are produced by a suspension polymerization method, a dispersion polymerization method, an emulsion polymerization method, an emulsion polymerization aggregation method or the like, examples of the polymerizable monomer to obtain the toner resin that constitutes the parent toner particles include styrene, styrene derivatives, and vinyl-based monomers such as methacrylic acid ester derivatives, acrylic acid ester derivatives, and acrylic acid or methacrylic acid derivatives. These vinyl-based monomers can be used singly, or two or more kinds can be used in combination.

Furthermore, it is preferable to use, as a polymerizable monomer, for example, a monomer having an ionic dissociative group such as a carboxyl group, a sulfonic acid group or a phosphoric acid group, in combination.

Furthermore, it is also possible to obtain a binding resin having a crosslinked structure by using a polyfunctional vinyl compound as a polymerizable monomer.

(Colorant)

There are no particular limitations on the colorant that is incorporated into the parent toner particles, and various known colorants can be used.

Regarding an amount of the colorant added, the colorant is preferably added in an amount of 0.5 to 20 parts by weight, and more preferably 2 to 10 parts by weight, relative to 100 parts by weight of the toner. The amount of the colorant added of 0.5 parts by weight or greater relative to 100 parts by weight of the toner is preferable from the viewpoint of securing the image density and reducing an amount of adhering toner. The amount of the colorant added of 20 parts by weight or less relative to 100 parts by weight of the toner is preferable from the viewpoint that a satisfactory image quality can be obtained.

(Mold Releasing Agent)

There are no particular limitations on the mold releasing agent that is incorporated into the parent toner particles, and various known waxes can be used.

As such, when the parent toner particles are constituted to include a mold releasing agent, fixability of the toner is enhanced.

Regarding an amount of the mold releasing agent added, the mold releasing agent is preferably added in an amount of 0.1 to 30 parts by weight, and more preferably 1 to 15 parts by weight, relative to 100 parts by weight of the toner. The amount of the mold releasing agent added of 0.1 parts by weight or greater relative to 100 parts by weight is preferable from the viewpoint of suppressing image defects caused by detachment failure between a fixing member and an image. The amount of the mold releasing agent added of 30 parts by weight or legs relative to 100 parts by weight is preferable from the viewpoint of obtaining a satisfactory image quality.

(Method for Producing Toner)

A method for producing a toner may be a so-called pulverization method, or may be a toner production method according to a polymerization method, and in many cases, an external additive is added after the formation of toner particles.

(External Additive)

There are no particular limitations on the external additive, and various known external additives can be used. Examples thereof include inorganic oxides such as silica, alumina, titanium oxide, and calcium titanate; and fatty acid metal salts such as calcium stearate and zinc stearate. These can be used singly, or two or more kinds can be used in combination.

It is preferable that these inorganic compounds be surface-treated with a silane coupling agent, a titanium coupling agent, a higher fatty acid, a silicone oil or the like, for the purpose of enhancing heat resistant storage properties and environmental stability.

An amount of the external additive added may be 0.05 to 10 parts by weight, and preferably 0.1 to 5 parts by weight, relative to 100 parts by weight of the parent toner particles. The amount of the external additive added of 0.05 part by weight or greater relative to 100 parts by weight is preferable in view of the fluidity and securement of chargeability of the toner. The amount of the external additive added of 10 parts by weight or less relative to 100 parts by weight is preferable from the viewpoint of suppressing contamination of the carrier with the external additive.

A particle diameter of the external additive is not particularly limited, and any conventionally known size can be used. The particle diameter is, as the number average particle diameter, preferably in the range of 1 to 2000 nm, and more preferably in the range of 5 to 250 nm. The external additive, when migrates from the toner to the carrier 1 and remains on the surface of the carrier 1, causes a decrease in the amount of electric charge. The number average particle diameter of the external additive of 1 nm or greater is preferable from the viewpoint that transferability or cleanability can be enhanced and the external additive can be easily detached without remaining on the surface of the carrier 1, and thus decrease in the amount of electric charge can be prevented. On the other hand, the number average particle diameter of the external additive of 2000 nm or less is preferable from the viewpoint that decrease in an initial amount of electric charge of the developer can be prevented.

Meanwhile, the number average particle diameter of the external additive is calculated by the following method.

A measurement sample is observed with a transmission electron microscope, "JEM-2010F" (manufactured by JEOL, Ltd.) in a field of vision at a magnification of 50,000 times, and the particle diameter in that field of vision is measured. Meanwhile, measurements are taken at 100 sites, and if the number of measurement is insufficient in a single field of vision in a photograph, the number of fields of vision is increased until the number of measurement of 100 is fulfilled.

(Particle Diameter of Toner Particles)

A particle diameter, as a volume medium diameter (D50), of the toner particles is preferably 2.5 to 7.5 μm. When the volume medium diameter is as small as 2.5 μm to 7.5 μm, reproducibility of fine lines or high image quality of photographic images can be achieved, and print products of a high image quality can be obtained.

The volume medium diameter (D50) of the toner is measured and calculated by using an analyzer in which a computer system mounted with a data processing software, "Software V3.51" is connected to a particle sizing and counting analyzer "MULTISIZER-3" (manufactured by Beckman Coulter, Inc.). Specifically, 0.02 g of a toner is added to 20 ml of a surfactant solution (a surfactant solution for dispersing a toner therein, which is prepared by, for example, diluting a neutral detergent containing a surfactant component 10 times with pure water) and then accustomed thereto, and the mixture is subjected to ultrasonic dispersion for one minute to prepare a toner dispersion. This toner dispersion is injected with a pipette into a beaker containing a diluent "ISOTON II" (manufactured by Beckman Coulter, Inc.) in a sample stand, until the indicated concentration of the analyzer reaches 5 to 10%. For the analyzer, while the number of measured particle counts is set to 25,000 and the aperture diameter is set to 50 μm, a measurement range of 1 to 30 μm is partitioned into 256 sections, and the frequency values are calculated. The particle diameter at 50% of the cumulative volume fractions counted from the larger volume fractions is designated as the volume medium diameter.

(Preparation of Two-Component Developer)

Next, preparation of the two-component developer will be explained.

The two-component developer can be prepared by mixing a carrier with a toner. A mixing ratio of the carrier and the toner is preferably 2 to 15 parts by weight of the toner relative to 100 parts by weight of the carrier. The use toner in an amount of 2 parts by weight or greater relative to 100 parts by weight of the carrier is preferable in view of securing developability. The use of toner an amount of 15 parts by weight or less relative so 100 parts by weight of the carrier is preferable in view of charge stability. Mixing of the carrier and the toner can be carried out by using various known mixing apparatuses such as a Turbula mixer, a Henschel mixer, a Nauta mixer, and a V-type mixer.

(Image Forming Method)

The two-component developer of the present invention can be used in a black-and-white print image forming method, or a full-color printing image forming method.

Hereinafter, an image forming apparatus used in a full-color print image forming method will be described.

(Image Forming Apparatus)

Figure 3:
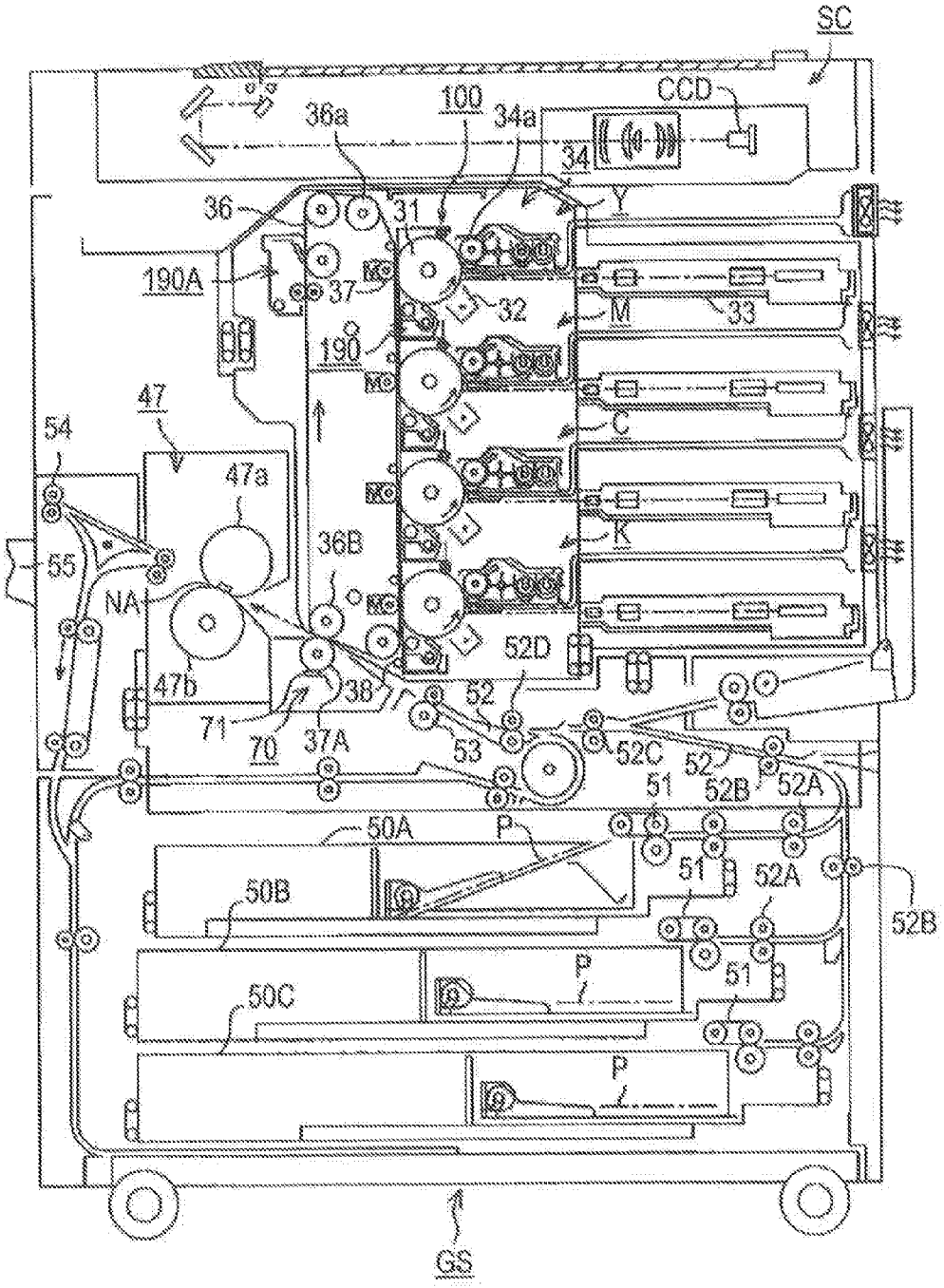
FIG. 3 is a schematic cross-sectional diagram illustrating an example of a color image forming apparatus capable of using the two-component developer of the present invention. In the FIG. 3, reference numeral 31 represents a photoreceptor drum; reference numeral 32 represents a charger; reference numeral 33 represents an exposure optical system as image writing unit; reference numeral 34 represents a developing apparatus; reference numeral 34*a* represents a developing roller; reference numeral 36 represents an intermediate transfer member; reference numeral 36*a* represents a tension roller; reference numeral 36B represents a back-up roller; reference numeral 37 represents a primary transfer roller; reference numeral 37A represents a secondary transfer member; reference numeral 38 represents a detecting sensor; reference numeral 47 represents a fixing apparatus; reference numeral 47*a* represents a heating roller; reference numeral 47*b* represents a pressing belt; reference numeral 50A, 50B, 50C represent a paper supply cassette; reference numeral 51 represents a transport roller; reference numeral 52 represents a conveyance path; reference numeral 52A represents a paper supply roller; reference numeral 52B, 52C, 52D represents a conveyance roller; reference numeral 53 represents a resist roller; reference numeral 54 represents an ejection roller; reference numeral 55 represents an ejection tray; reference numeral 70 represents a secondary transfer apparatus; reference numeral 100 represents a process unit for yellow (Y), magenta (M), cyan (C) and black (K); reference numeral 190 represents a photoreceptor cleaning apparatus as image carrier cleaning unit; reference numeral 190A represents an intermediate transfer member cleaning apparatus; reference numeral GS represents an image forming apparatus; reference numeral SC represents an image reading apparatus; reference numeral CCD represents a line image sensor; and reference numeral P represents an image support.

FIG. 3 is a cross-sectional schematic diagram illustrating an example of a color image forming apparatus capable of using the two-component developer of the present invention.

First, an outline of an image forming apparatus for color electrophotography equipped with a detecting sensor and a secondary transfer apparatus will be described.

An image forming apparatus GS is an apparatus called a tandem type color image forming apparatus, in which image forming units that form color toner images of yellow, magenta, cyan and black, respectively, are disposed along the direction of movement of an intermediate transfer member 36, color toner images formed on image carriers of the respective image forming units are multiple transferred and superimposed on an intermediate transfer member, and then the color toner images are collectively transferred onto an image support.

In FIG. 3, a draft image placed on an image reading apparatus SC that is disposed at a position which occupies the upper part of the image forming apparatus GS, is exposed by scanning with an optical system, and is read by a line image sensor CCD. The analogue signals photoelectrically converted by the line image sensor CCD are subjected to analogue processing, A/D conversion, shading compensation, image compression processing, and the like in an image processing unit, and then image data signals are sent to an exposure optical system 33 as an image writing unit.

Examples of the intermediate transfer member 36 include a drum type member and an endless belt type member, and both have the same function. However, in the following descriptions, the intermediate transfer member is intended to refer to an endless belt type intermediate transfer member 36.

Furthermore, in FIG. 3, four process units 100 for forming images of the colors of yellow (Y), magenta (M), cyan (C) and black (K), respectively, are provided along the peripheral area of the intermediate transfer 36. The process units 100 are units for forming color toner images, and are longitudinally disposed along the intermediate transfer member 36 in a direction perpendicular to the rotating direction of the intermediate transfer unit 36, which is a vertical direction as indicated by the arrow in the diagram. The process units are disposed in the order of Y, K, C, and K.

The four process units 100 all have a common structure, and respectively include a photoreceptor drum 31, a charger 32 as a charging unit, an exposure optical system 33 as an image writing unit, a developing apparatus 34, and a photoreceptor cleaning apparatus 190 as an image carrier cleaning unit.

The photoreceptor drum 31 is a member in which, for example, a photosensitive layer having a layer thickness (film thickness) of about 20 to 40 μm is formed on the outer periphery of a cylindrical, substrate formed from a metallic member made of aluminum or the like, which has an outer diameter of about. 40 to 100 mm. The photoreceptor drum 31 is rotated by a motive power supplied from a driving force that is not depicted, in the direction of the arrow while the substrate is earthed, for example, at a linear velocity of about 80 to 280 mm/s, and preferably 220 mm/s.

Around the photoreceptor drum 31, a set of an image forming unit which combines a charger 32 as a charging unit, an exposure optical system 33 as an image writing unit, and a developing unit 34, is disposed in the rotating direction of the photoreceptor drum 31 indicated by the arrow in the diagram.

The charger 32 as a charging unit is installed close to the photoreceptor drum 31, so as to face the photoreceptor drum 31, in a direction parallel to the axis of rotation of the photoreceptor drum 31. The charger 32 includes a discharge wire as a corona discharge electrode that gives a predetermined potential to the photosensitive layer of the photoreceptor drum 31, and performs a charging action through corona discharge of the same polarity as the polarity of the toner (negative charging in the present embodiment), thereby giving a uniform potential to the photoreceptor drum 31.

In the exposure optical system 33, which is an image wiring unit, laser light that is emitted from a semiconductor laser (LD) light, source which is not depicted in the diagram, rotates and scans in the main scanning direction by means of a rotating polygon mirror (without a reference numeral) and goes through a fθ lens (without a reference numeral), a reflecting mirror (without a reference numeral) and the like, and exposure (image writing) is performed on the surface of the photoreceptor drum 31 by means of electric signals that correspond to image signals. Thus, an electrostatic latent image corresponding to the draft image is formed on the photosensitive layer of the photoreceptor drum 31.

The developing apparatus 34 as a developing unit includes a developing roller 34*a* that accommodates a two-component developer (product of the present invention) for each of the colors of yellow (Y), magenta (M), cyan (C) and black (K), which is charged to the same polarity as the charging polarity of the photoreceptor drum 31, and is a developer carrier formed from, for example, a cylindrical non-magnetic stainless steel or aluminum material having a thickness of 0.5 to 1 mm and an external diameter of 15 to 25 mm. The developing roller 34*a* is maintained to be not in contact with the photoreceptor drum 31 by means of a pressure roller (not depicted in the diagram) with a predetermined gap, for example, 100 to 1000 μm, and is set to rotate in the same direction as the rotating direction of the photoreceptor drum 31. At the time of development, a direct current voltage of the same polarity as that of the toner (in the present embodiment, negative polarity), or a developing bias voltage that superimposes an alternating current to a direct current voltage, is applied to the developing roller 34*a*, and thereby reversal development is carried out for the exposed areas on the photoreceptor drum 31.

As the intermediate transfer body 36, a semiconductive endless (seamless) resin belt having a volume resistivity of about $1.0\times10^{7}$ to $1.0\times10^{9}$ Ω·cm and a surface resistivity of about $1.0\times10^{10}$ to $1.0\times10^{12}$ Ω/L is used. As the resin belt, a semiconductive resin film having a thickness of 0.05 to 0.5 mm, in which an electrically conductive material is dispersed in a higher performance plastic such as a modified polyimide, a thermosetting polyimide, an ethylene-tetrafluoroethylene copolymer, polyvinylidene fluoride, or a nylon alloy, can be used. As the intermediate transfer member 36, in addition to these, a semiconductive rubber belt having a thickness of 0.5 to 2.0 mm, in which an electrically conductive material is dispersed in a silicone rubber, a urethane rubber or the like, can also be used. The intermediate transfer member 36 is wound around plural roller members including a tension roller 36*a* and a back-up roller 36B that faces a secondary transfer member, and is supported so as to be capable of moving rotationally in a vertical direction.

A primary transfer roller 37 as a first transfer unit for each color is formed from, for example, a roller-shaped electroconductive member using an expanded rubber such as silicone or urethane, and is installed to face the photoreceptor drums 31 for each color, with the intermediate transfer member 36 interposed therebetween. The primary transfer roller 37 presses against the back surface of the intermediate transfer member 36, and forms a transfer region between the primary transfer roller and the photoreceptor drum 31. A constant current of direct current of a polarity opposite to the polarity of the toner (in the present embodiment, positive polarity) is applied to the primary transfer roller 37 by constant current control, and by the transfer electric field formed in the transfer region, the toner image on the photoreceptor drum 31 is transferred onto the intermediate transfer member 36.

The toner image transferred onto the intermediate transfer member 36 is transferred to an image support P. A detecting sensor 38 that measures the density of the patch image toner is provided on the periphery of the intermediate transfer body 36.

In order to clean residual toner on the intermediate transfer member 36, a cleaning apparatus 190A is provided.

Furthermore, in order to clean the patch image toner on the secondary transfer member 37A, a secondary transfer apparatus 70 is provided.

Next, the image forming steps (image forming processes) will be described.

At the beginning of image recording, the photoreceptor drum 31 for Y is rotated in the direction indicated by the arrow in the diagram, by starting a photoreceptor driving motor that is not depicted in the diagram, and a potential is applied to the photoreceptor drum 31 for Y by the charger 32 for Y. After a potential is applied to the photoreceptor drum 31 for Y, exposure (image writing) is carried out by the exposure optical system 33 for Y by means of a first color signal, that is, an electric signal corresponding to the image data of Y, and thus an electrostatic latent image corresponding; to the image of yellow color (Y) is formed on the photoreceptor drum 31 for Y. This latent image is reversely developed by the developing apparatus 34 for Y, and a toner image formed with a toner of yellow color (Y) is formed on the photoreceptor drum 31 for Y. The toner image for Y formed on the photoreceptor drum 31 for Y is transferred onto the intermediate transfer member 36 by the primary transfer roller as a primary transfer unit.

Subsequently, a potential is applied to the photoreceptor drum 31 for M by the charger 32 for M. After a potential is applied to the photoreceptor drum 31 for M, exposure (image writing) is carried out by the exposure optical system 33 for M by means of a first color signal, that is, an electric signal corresponding to the image data of M, and thus an electrostatic latent image corresponding to the image of magenta color (M) is formed on the photoreceptor drum 31 for M. This latent image is reversely developed by the developing apparatus 34 for M, and a toner image formed with a toner of magenta color (M) is formed on the photoreceptor drum 31 for M. The toner image for M formed on the photoreceptor drum 31 for M is transferred onto the intermediate transfer member 36, while being superimposed on the toner image of Y, by the primary transfer roller 37 as a primary transfer unit.

Through the same process, a toner image formed with a toner of cyan color (C) formed on the photoreceptor drum 31 for C, and a toner image formed with a toner of black color (K) formed on the photoreceptor drum 31 for K are sequentially formed to be superimposed on the intermediate transfer member 36, and a superimposed color toner image formed with the toners of Y, M, C and K is formed on the peripheral surface of the intermediate transfer member 36.

The toner remaining on the peripheral surface of each of the photoreceptor drums 31 after transfer is cleaned by the photoreceptor cleaning apparatus 190.

On the other hand, an image support P as a recording paper accommodated in paper supply cassettes 50A, 50B and 50C, is supplied by a transport roller 51 and a paper supply roller 52A that are provided in each of the paper supply cassettes 50A, 50B and 50C, and is conveyed over a conveyance path 52 by conveyance rollers 52B, 52C and 52D. The image support P is conveyed, via a resist roller 53, to a second transfer member 37A as a secondary transfer unit to which a voltage having a polarity opposite to the polarity of the toner (in the present embodiment, positive polarity) is applied, and in the transfer region of the secondary transfer member 37A, a superimposed color toner image (color image) formed on the intermediate transfer member 36 is transferred all at once onto the image support P.

The image support P on which a color image has been transferred, is heated and pressed at the nip section formed by a heating roller 47*a* and a pressing belt 47*b* of a fixing apparatus 47, to have the color image fixed thereon, and the image support is sandwiched between ejection rollers 54 and placed on an ejection tray 55 outside the machine.

After a color image is transferred onto the image support P by the secondary transfer member 37A as a secondary transfer unit, the residual toner on the intermediate transfer member 36 generated by self-stripping of the image support P is removed by an intermediate transfer member cleaning apparatus 190A.

Furthermore, the patch image toner on the secondary transfer member 37A is cleaned by a cleaning blade 71 of the secondary transfer apparatus 70.

As discussed above, in regard to the image forming apparatus (developing machine) used in the image forming method which can use the two-component developer of the present invention, although there are no particular limitations, it is preferable that the starting torque of the image developing apparatus (developing machine) be set to 1.5 N·m or less, and preferably in the range of 1.3 to 1.5N·m. When the starting torque of the developing machine is 1.5 N·m or less, satisfactory image forming can be achieved without the shrinkage of the coating resin layer 3 of the particles of the carrier 1 being excessively accelerated. However, the present invention is not intended to be limited to the scope as described above, and it is needless to say that even in the case where starting torque does not fall in the range described above, any developing machine can be used as long as the effects by the two-component developer of the present invention can be effectively manifested. The measurement of the starting torque of the developing roller can be carried out by using a dynamic torque meter (TP-10KCE) manufactured by Kyowa Electronic Instruments Co., Ltd. As the starting torque, the maximum value in the early stage of start as determined with a torque meter is employed.

EXAMPLES

Hereinafter, the present invention will be described more specifically by way of the following Examples, but the present invention is not intended to be limited to these. Meanwhile, in the descriptions, the unit "parts" indicates "Parts by weight" in all, cases.

The volume average primary particle diameter of particles of a resin for coating was determined by analyzing a resin particle dispersion by using a dynamic light scattering type particle size analyzer, "MICROTRAC UPA-150" (manufactured by Nikkiso Co., Ltd.).

[Production of Resin for Coating 1]

In a reaction vessel equipped with a stirring apparatus, a temperature sensor, a cooling tube, and a nitrogen introducing apparatus, 7.08 parts by weight of sodium dodecyl sulfate as an anionic surfactant was dissolved in 3,010 parts by weight of ion-exchanged water, to prepare a surfactant solution. Subsequently, 2.0 parts by weight of potassium persulfate (KPS) as a polymerization initiator, 50 parts by weight of 1-cyclohexyl-2-methyl-2-propen-1-one, and 50 parts by weight of methyl methacrylate (MMA) were introduced into the surfactant solution, and the mixture was subjected to emulsion polymerization (polymerization temperature: 75° C.) to prepare a "resin for coating 1". The volume average particle diameter of the particles of the "resin for coating 1" thus obtained was 110 nm, and the weight average molecular weight was 340,000. The kinds of the polymerizable monomer composition used in the polymerization of the resin for coating and the weight ratio of the vinyl ketone monomer and the another polymerizable monomer (hereinafter, referred to as copolymerization ratio) as the time of forming a copolymer resin as a resin for coating are shown in Table 1.

[Production of Resin for Coating 2]

A "resin for coating 2" was prepared in the same manner as in the section [Production of resin for coating 1], except that 80 parts by weight of 1-cyclohexyl-2-methyl-2-propen-1-one and 20 parts by weight of MMA were used instead of 50 parts by weight of 1-cyclohexyl-2-methyl-2-propen-1-one and 50 parts by weight of MMA. The volume average particle diameter of the particles of the "resin for coating 2" thus obtained was 120 nm, and the weight average molecular weight was 300,000. The kinds of the polymerizable monomer composition and copolymerization ratio used in the polymerization of the resin for coating 2 are shown in Table 1.

[Production of Resin for Coating 3]

A "resin for coating 3" was prepared in the same manner as in the section [Production of resin for coating 1], except that 40 parts by weight of 1-cyclohexyl-2-methyl-2-propen-1-one and 60 parts by weight of MMA were used instead of 50 parts by weight of 1-cylohexyl-2-methyl-2-propen-1-one and 50 parts by weight of MMA. The volume average particle diameter of the particles of the "resin for coating 3" thus obtained was 110 nm, and the weight average molecular weight was 250,000. The kinds of the polymerizable monomer composition and copolymerization ratio used in the polymerization of the resin for coating 3 are shown in Table 1.

[Production of Resin for Coating 4]

A "resin for coating 4" was prepared in the same manner as in the section [Production of resin for coating 1], except that 50 parts by weight of 1-cyclopentyl-2-methyl-2-propen-1-one and 50 parts by weight of MMA were used instead of 50 parts by weight of 1-cylohexyl-2-methyl-2-propen-1-one and 50 parts by weight of MMA. The volume average particle diameter of the particles of the "resin for coating 4" thus obtained was 110 nm, and the weight average molecular weight was 320,000. The kinds of the polymerizable monomer composition and copolymerization ratio used in the polymerization of the resin for coating 4 are shown in Table 1.

[Production of Resin for Coating 5]

A "resin for coating 5" was prepared in the same manner as in the section [Production of resin for coating 1], except that 50 parts by weight of 2-methyl-1-phenyl-2-propen-1-one and 50 parts by weight of MMA were used instead of 50 parts by weight of 1-cylohexyl-2-methyl-2-propen-1-one and 50 parts by weight of MMA. The volume average particle diameter of the particles of the "resin for coating 5" thus obtained was 120 nm, and the weight average molecular weight was 350,000. The kinds of the polymerizable monomer composition and copolymerization ratio used in the polymerization of the resin for coating 5 are shown in Table 1.

[Production of Resin for Coating 6]

A "resin for coating 6" was prepared in the same manner as in the section [Production of resin for coating 1], except that 50 parts by weight of 2-methyl-1-(2-methylcyclohexyl)-2-propen-1-one and 50 parts by weight of MMA were used instead of 50 parts by weight of 1-cylohexyl-2-methyl-2-propen-1-one and 50 parts by weight of MMA. The volume average particle diameter of the particles of the "resin for coating 6" thus obtained was 110 nm, and the weight average molecular weight was 220,000. The kinds of the polymerizable monomer composition and copolymerization ratio used in the polymerization of the resin for coating 6 are shown in Table 1.

[Production of Resin for Coating 7]

A "resin for coating 7" was prepared in the same manner as in the section [Production of resin for coating 1], except that 100 parts by weight of 1-cyclohexyl-2-methyl-2-propen-1-one was used instead of 50 parts by weight of 1-cylohexyl-2-methyl-2-propen-1-one and 50 parts by weighs of MMA. The volume average particle diameter of the particles of the "resin for coating 7" thus obtained was 100 nm, and the weight average molecular weight was 270,000. The kinds of the polymerizable monomer composition and copolymerization ratio (for homopolymerization, there was no copolymerization ratio, and the copolymerization ratio was indicated as "-" in Table 1) used in the polymerization of the resin for coating 7 are shown in Table 1.

[Production of Resin for Coating 8]

A "resin for coating 8" was prepared in the same manner as in the section [Production of resin for coating 1], except that 50 parts by weight of 1-cyclohexyl-2-methyl-2-propen-1-one and 50 parts by weight of cyclohexyl methacrylate (CHMA) were used instead of 50 parts by weight of 1-cylohexyl-2-methyl-2-propen-1-one and 50 parts by weight of MMA. The volume average particle e diameter of the particles of the "resin for coating 8" thus obtained was 120 nm, and the weight average molecular weight was 300,000. The kinds of the polymerizable monomer composition and copolymerization ratio used in the polymerization of the resin for coating 8 are shown in Table 1.

[Production of Resin for Coating 9]

A "resin for coating 9" was prepared in the same manner as in the section [Production of resin for coating 1], except that 50 parts by weight of CHMA and 50 parts by weight of MMA were used instead of 50 parts by weight of 1-cylohexyl-2-methyl-2-propen-1-one and 50 parts by weight of MMA. The volume average particle diameter of the particles of the "resin for coating 9" thus obtained was 100 nm, and the weight average molecular weight was 200,000. The kinds of the polymerizable monomer composition and copolymerization ratio used in the polymerization of the resin for coating 9 are shown in Table 1.

[Production of Resin for Coating 10]

A "resin for coating 10" was prepared in the same manner as in the section [Production of resin for coating 1], except that 50 parts by weight of cyclopentyl methacrylate and 50 parts by weight of MMA were used instead of 50 parts by weight of 1-cylohexyl-2-methyl-2-propen-1-one and 50 parts by weight of MMA. The volume average particle diameter of the particles of the "resin for coating 10" thus obtained was 90 nm, and the weight average molecular weight was 250,000. The kinds of the polymerizable monomer composition and copolymerization ratio used in the polymerization of the resin for coating 10 are shown in Table 1.

TABLE 1

| Resin for coating | Polymerizable monomer 1 | Polymerizable monomer 2 | Copolymerization ratio Parts by weight/ Parts by weight |
|---|---|---|---|
| Resin for coating 1 | 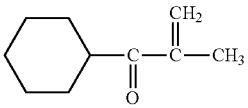 1-cyclohexyl-2-methyl-2-propen-1-one | 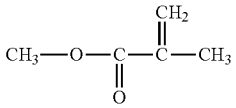 MMA | 50/50 |
| Resin for coating 2 | 1-cyclohexyl-2-methyl-2-propen-1-one | MMA | 80/20 |
| Resin for coating 3 | 1-cyclohexyl-2-methyl-2-propen-1-one | MMA | 40/60 |
| Resin for coating 4 | 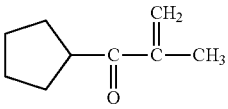 1-cyclohexyl-2-methyl-2-propen-1-one | MMA | 50/50 |
| Resin for coating 5 | 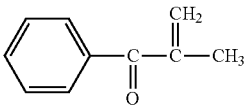 2-methyl-1-penyl-2-propen-1-one | MMA | 50/50 |
| Resin for coating 6 | 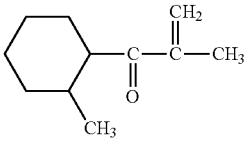 2-methyl-1-(2-methylcyclohexyl)-2-propen-1-one | MMA | 50/50 |
| Resin for coating 7 | 1-cyclohexyl-2-methyl-2-propen-1-one | — | — |
| Resin for coating 8 | 1-cyclohexyl-2-methyl-2-propen-1-one | 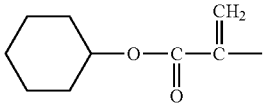 CHMA | 50/50 |
| Resin for coating 9 | 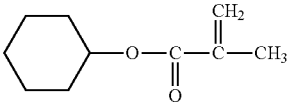 cyclohexyl methacrylate (CHMA) | MMA | 50/50 |

TABLE 1-continued

| Resin for coating | Polymerizable monomer 1 | Polymerizable monomer 2 | Copolymerization ratio Parts by weight/ Parts by weight |
|---|---|---|---|
| Resin for coating 10 | 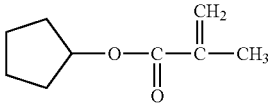 cyclopentyl methacrylate | MMA | 50/50 |

[Production of Carrier 1]

Next, 100 parts by weight of a carrier core material which had been prepared separately and was formed from Mn—Mg ferrite particles having a volume average primary particle diameter of 60 μm and a saturation magnetization of $10.0\times10^{-5}$ Wb·m/kg, and 2 parts by weight of the "resin for coating 1" were introduced into a high-speed stirring mixer equipped with a stirring blade shown in FIG. 1. The mixture was stirred and mixed for 30 minutes at 120° C., to yield a "carrier 1" having a surface of the core material coated with a resin by action of mechanical impact force.

[Production of Carrier 2]

A "carrier 2" was obtained in the same manner as in the section [Production of carrier 1], except that the "resin for coating 2" was used instead of the "resin for coating 1".

[Production of Carrier 3]

A "carrier 3" was obtained in the same manner as in the section [Production of carrier 1], except that the "resin for coating 3" was used instead of the "resin for coating 1".

[Production of Carrier 4]

A "carrier 4" was obtained in the same manner as in the section [Production of carrier 1], except that the "resin for coating 4" was used instead of the "resin for coating 1".

[Production of Carrier 5]

A "carrier 5" was obtained in the same manner as in the section [Production of carrier 1], except that the "resin for coating 5" was used instead of the "resin for coating 1".

[Production of Carrier 6]

A "carrier 6" was obtained in the same manner as in the section [Production of carrier 1], except that the "resin for coating 6" was used instead of the "resin for coating 1".

[Production of Carrier 7]

A "carrier 7" was obtained in the same manner as in the section [Production of carrier 1], except that the "resin for coating 7" was used instead of the "resin for coating 1".

[Production of Carrier 8]

A "carrier 8" was obtained in the same manner as in the section [Production of carrier 1], except that the "resin for coating 8" was used instead of the "resin for coating 1".

[Production of Carrier 9]

A "carrier 9" was obtained in the same manner as in the section [Production of carrier 1], except that the "resin for coating 9" was used instead of the "resin for coating 1".

[Production of Carrier 10]

A "carrier 10" was obtained in the same manner as in the section [Production of carrier 1], except that the "resin for coating 10" was used instead of the "resin for coating 1". The correlations between the respective carriers and the respective resins for coating are presented in Table 2.

TABLE 2

| | Resin for coating |
|---|---|
| Carrier 1 | Resin for coating 1 |
| Carrier 2 | Resin for coating 2 |
| Carrier 3 | Resin for coating 3 |
| Carrier 4 | Resin for coating 4 |
| Carrier 5 | Resin for coating 5 |
| Carrier 6 | Resin for coating 6 |
| Carrier 7 | Resin for coating 7 |
| Carrier 8 | Resin for coating 8 |
| Carrier 9 | Resin for coating 9 |
| Carrier 10 | Resin for coating 10 |

[Production of Toner]

A toner was produced as follows.

(Production of Resin Particles for Core)

Production of Resin Particles 1H

In a reaction vessel equipped with a stirring apparatus, a temperature sensor, a cooling tube, and a nitrogen introducing apparatus, 7.08 parts by weight of sodium dodecyl sulfate as an anionic surfactant was dissolved in 3,010 parts by weight of ion-exchanged water, to prepare a surfactant solution. While this surfactant solution was stirred at a stirring speed of 230 rpm, under a nitrogen gas stream, the temperature in the reaction vessel was increased to 80° C.

Subsequently, a polymerization initiator solution prepared by dissolving 9.2 parts by weight of potassium persulfate (KPS) as a polymerization Initiator in 200 parts by weight of ion-exchanged water was introduced into the surfactant solution, and the temperature in the reaction vessel, was adjusted to 75° C. Subsequently, a mixture [a1] prepared by mixing:

| | |
|---|---|
| Styrene | 69.4 parts by weight |
| n-Butyl acrylate | 28.3 parts by weight |
| Methacrylic acid | 2.3 parts by weight |

was added dropwise thereto over one hour, and the mixture was polymerized by stirring for 2 hours at 75° C., prepare a resin particle dispersion [1H] having resin particles 1H dispersed therein.

Production of Resin Particles 1HM

In a flask equipped with a stirring apparatus,

| | |
|---|---|
| Styrene | 97.1 parts by weight |
| n-Butyl acrylate | 39.7 parts by weight |
| Methacrylic acid | 3.22 parts by weight |

-continued

| | |
|---|---|
| n-Octyl-3-mercaptopropionic acid ester were introduced, and | 5.6 parts by weight |
| Pentaerythritol tetrabehenate | 98.0 parts by weight |

was further added thereto. The mixture was heated to 90° C., to prepare a mixture [a2] having the compounds described above mixed together.

Separately, in a reaction vessel equipped with a stirring apparatus, a temperature sensor, a cooling tube, and a nitrogen introducing apparatus, a surfactant solution was prepared by dissolving 1.6 parts by weight of sodium dodecyl sulfate in 2,700 parts by weight of ion-exchanged water, and heated to 98° C. The resin particle dispersion [1H] was added to this surfactant solution in an amount of 28 parts by weight in terms of solids content, and then the mixture [a2] was introduced thereto. Furthermore, the mixture was mixed and dispersed for 2 hours by using a mechanical dispersing apparatus having a circulation path, "CLEARMIX" (manufactured by M Technique Co., Ltd.), to prepare a dispersion (emulsion).

Subsequently, an initiator solution prepared by dissolving 5.1 parts by weight of potassium persulfate (KPS) in 240 parts by weight of ion-exchanged water, and 750 parts by weight of ion-exchanged water were added to this emulsion, and this reaction system was stirred for 2 hours at 98° C., to perform polymerization. By this, a resin particle dispersion [1HM] having the resin particles 1HM having a composite structure in which the surface of the resin particles 1H was coated with a resin dispersed therein.

Production of Resin Particles 1HML

An initiator solution prepared by dissolving 7.4 parts by weight of potassium peroxide (KPS) in 200 parts by weight of ion-exchanged water, was added to the resin particle dispersion [1HM], and the temperature thereof was adjusted to 80° C. Subsequently, a mixture [a3] prepared by mixing:

| | |
|---|---|
| Styrene | 277 parts by weight |
| n-butyl acrylate | 113 parts by weight |
| Methacrylic acid | 9.21 parts by weight |
| n-octyl-3-mercaptopropionic acid ester | 10.4 parts by weight |

was added dropwise thereto over one hour. After completion of this dropwise addition, while the system was maintained at 80° C., the system was heated and stirred over 2 hours, to perform polymerization. Then the reaction system was cooled to 28° C. By this, a resin particle dispersion [1HML] having resin particles 1HML having a composite structure in which the surface of the resin particles 1HM was coated with a resin dispersed therein. The resin particles thus obtained are referred to as "resin particles for core".

(Production of Resin Fine Particles for Shell Formation)

In a reaction vessel equipped with a stirring apparatus, a temperature sensor, a cooling tube, and a nitrogen introducing apparatus, 2.0 parts by weight of sodium dodecyl sulfate as an anionic surfactant was dissolved in 3000 parts by weight of ion-exchanged water, to prepare a surfactant solution. While this surfactant solution was stirred at a stirring speed of 230 rpm under a nitrogen gas stream, the internal temperature was increased to 80° C.

Separately, the following compounds were added and mixed, to prepare a "mixture a4". That is, the mixture consisted of:

| | |
|---|---|
| Styrene | 544 parts by weight |
| n-Butyl acrylate | 160 parts by weight |
| Methacrylic acid | 96 parts by weight |
| n-Octylmercaptan (NOM) | 20 parts by weight. |

Into the surfactant solution, an initiator solution prepared by dissolving 10 parts by weight of potassium persulfate (KPS) in 200 parts by weight of ion-exchanged water was added, and then the "mixture a4" was added dropwise thereto over 3 hours. This system was adjusted to 80° C., and was heated and stirred over one hour to perform polymerization. By this, a dispersion of "resin fine particles for shell formation" was prepared.

(Preparation of Carbon Black Dispersion)

While a solution prepared by stirring and dissolving 90 parts by weight of sodium dodecyl sulfate in 1600 parts by weight of ion-exchanged water was stirred, 420 parts by weight of carbon black, "MOGUL L", was slowly added to the solution. Subsequently, the mixture was subjected to dispersing treatment by using a stirring apparatus, "CLEARMIX (manufactured by M Technique Co., Ltd.)", to prepare a "carbon black dispersion". The particle diameter of the carbon black in the "carbon black dispersion" was measured by using an electrophoretic light scattering photometer, "ELS-800" (manufactured by Otsuka Electronics Co., Ltd.), to find the particle diameter as the weight average particle diameter of 110 nm.

(Process of Forming Core Particles (Salting Out/Fusion (Association/Fusion))

In a reaction vessel equipped with a stirring apparatus, a temperature sensor, a cooling tube, and a nitrogen introducing apparatus,

| | |
|---|---|
| Dispersion of "resin fine particles for core" | 450 parts by weight (in terms of solids content) |
| Ion-exchanged water | 1100 parts by weight |
| "Carbon black dispersion" | 100 parts by weight |

(in terms of solids content) were introduced, and the liquid temperature thereof was adjusted to 30° C. Subsequently, a 5 mol/liter aqueous solution of sodium hydroxide was added thereto, to adjust the pH to 10.0.

While the reaction system was stirred, an aqueous solution prepared by dissolving 60 parts by weight of magnesium chloride•hexahydrate in 60 parts by weight of ion-exchanged water was added to the reaction system over 10 minutes. After the addition, the reaction system was left to stand for 3 minutes, and then temperature elevation was initiated. This system was heated to 90° C. over 60 minutes, and while the system as maintained at 90° C., the resin particles were subjected to association to grow the particles. The growth of the particles was monitored by measuring the particle diameter of associated particles by using a particle sizing and counting analyzer "MULTISIZER-3 (manufactured by Beckman Coulter, Inc.)". Then, when the volume medium diameter (D50) reached 5.5 μm, an aqueous solution prepared by dissolving 40.2 parts by weight of sodium chloride in 1000 parts by weight of ion-exchanged water, was added to the reaction system, to stop the growth of particles. Thus, a dispersion of "core particles" was formed.

(Formation of Shell)

Subsequently, 550 parts by weight (in terms of solids content) of the dispersion of "core particles" was heated to 90° C., and 50 parts by weight (in terms of solids content) of the dispersion of "resin fine particles for shell formation" was added thereto. The mixture was continuously stirred over one hour, to fuse the "resin fine particles for shell formation" to the surface of the "core particles". Thereafter, an aqueous solution prepared by dissolving 40.2 parts by weight of sodium chloride in 1000 parts by weight of ion-exchanged water was added to the system. This system was heated to 95° C., and was heated and stirred over 20 minutes, to perform aging treatment After shells were formed, the system was cooled to 30° C., to prepare a dispersion of parent toner particles.

The resultant dispersion of parent toner particles was filtered, and the parent toner particles were repeatedly washed with ion-exchanged water at 35° C. Subsequently, the parent toner particles were dried with hot air at 40° C., to form "parent toner particles" having the surface of a core coated with a shell.

(Mixing of External Additive to Parent Toner Particles)

To the parent toner particles thus obtained, 1.0% by weight of hydrophobic silica (number average primary particle diameter: 12 nm, degree of hydrophobicity: 68) and 1.5% by weight of hydrophobic titanium oxide (number average primary particle diameter: 20 nm, degree of hydrophobicity: 64) were added. The components was mixed by using a mixer, "HENSCHEL MIXER" (manufactured by Mitsui Miike Machinery Co., Ltd.), and then coarse particles were removed by using a sieve having a mesh size of 45 μm, to produce a "toner".

Example 1

Preparation of Two-Component Developer 1

100 parts by weight of the "carrier 1" produced as described above and 6 parts by weight of the "toner" were mixed for 5 minutes with a V-type mixer, to prepare a two-component developer 1.

Example 2

Preparation of Two-Component Developer 2

A "two-component developer 2" was prepared in the same manner as in section [Example 1: Preparation of two-component developer 1], except that the "carrier 2" was used instead of the "carrier 1".

Example 3

Preparation of Two-Component Developer 3

A "two-component developer 3" was prepared in the same manner as in section [Example 1: Preparation of two-component developer 1], except that the "carrier 3" was used instead of the "carrier 1".

Example 4

Preparation of Two-Component Developer 4

A "two-component developer 4" was prepared in the same manner as in section [Example 1: Preparation of two-component developer 1], except that the "carrier 4" was used instead of the "carrier 1".

Example 5

Preparation of Two-Component Developer 5

A "two-component developer 5" was prepared in the same manner as in section [Example 1: Preparation of two-component developer 1], except that the "carrier 5" was used instead of the "carrier 1".

Example 6

Preparation of Two-Component Developer 6

A "two-component developer 6" was prepared in the same manner as in section [Example 1: Preparation of two-component developer 1], except that the "carrier 6" was used instead of the "carrier 1".

Example 7

Preparation of Two-Component Developer 7

A "two-component developer 7" was prepared in the same manner as in section [Example 1: Preparation of two-component developer 1], except that the "carrier 7" was used instead of the "carrier 1".

Example 8

Preparation of Two-Component Developer 8

A "two-component developer 8" was prepared in the same manner as in section [Example 1: Preparation of two-component developer 1], except that the "carrier 8" was used instead of the "carrier 1".

Comparative Example 1

Preparation of Two-Component Developer 9

A "two-component developer 9" was prepared in the same manner as in section [Example 1: Preparation of two-component developer 1], except that the "carrier 9" was used instead of the "carrier 1".

Comparative Example 2

Preparation of Two-Component Developer 10

A "two-component developer 10" was prepared in the same manner as in section [Example 1: Preparation of two-component developer 1], except that the "carrier 10" was used instead of the "carrier 1".

By using the two-component developers 1 to 10 of Examples 1 to 8 and Comparative Examples 1 and 2, an amount of electric charge of the toner in each of the two-component developers in an NN (normal temperature and normal humidity) environment and an HH temperature and high humidity) environment was measured by using an apparatus for measuring amount of electric charge, "Blow-off type TB-200" (manufactured by Toshiba Corp.) The results thus obtained are shown in Table 3. Meanwhile, when the amount of electric charge of the toner was −20 μC/g to −60 μC/g, the amount of electric charge was considered as a level without problems.

TABLE 3

| | Carrier | Two-component developer | NN Amount of electric charge (A) (−μC/g) | HH Amount of electric charge (B) (−μC/g) | Environmental difference (A) − (B) (−μC/g) |
|---|---|---|---|---|---|
| Example 1 | Carrier 1 | Two-component developer 1 | 46 | 43 | 3 |
| Example 2 | Carrier 2 | Two-component developer 2 | 49 | 47 | 2 |
| Example 3 | Carrier 3 | Two-component developer 3 | 43 | 38 | 5 |
| Example 4 | Carrier 4 | Two-component developer 4 | 43 | 40 | 3 |
| Example 5 | Carrier 5 | Two-component developer 5 | 44 | 39 | 5 |
| Example 6 | Carrier 6 | Two-component developer 6 | 49 | 47 | 2 |
| Example 7 | Carrier 7 | Two-component developer 7 | 55 | 52 | 3 |
| Example 8 | Carrier 8 | Two-component developer 8 | 50 | 48 | 2 |
| Comparative Example 1 | Carrier 9 | Two-component developer 9 | 33 | 22 | 11 |
| Comparative Example 2 | Carrier 10 | Two-component developer 10 | 32 | 20 | 12 |

It is preferable that the environmental difference (difference in the amount of electric charge between the normal temperature and normal humidity environment and the high temperature and high humidity environment) of a two-component developer be as small as 10 μC/g or less. However, from the results of the Table 3, it can be seen that in the two-component developers 1 to 8 of Examples 1 to 8, the difference in the amount of electric charge of the two-component developer (difference between the normal temperature and normal humidity environment and the high temperature and high humidity environment) was 10 μC/g or less in all cases, and good results (effect of enhancing environmental stability of carrier charging performance, which induces suppression of environmental difference in charging) can be obtained. On the other hand, in the two-component developers 9 and 10 of Comparative Examples 1 and 2, the difference in the amount of electric charge of the two-component developer (difference between the normal temperature and normal humidity environment and the high temperature and high humidity environment) was greater than 10 μC/g in both cases, to demonstrate that only unsatisfactory results (results indicating that suppression of the environmental difference in charging is difficult) can be obtained. Meanwhile, it is preferable that the environmental difference of the two-component developers (difference in the amount of electric charge between the normal temperature and normal humidity environment and the high temperature and high humidity environment) be small, because usually, when the carrier captures moisture in high temperature and high humidity environment, leakage of electric charge occurs, to decrease an amount of electric charge and to induce overdevelopment. However, if the environmental difference of the two-component developer is small, leakage of electric charge does not occur even in high temperature and high humidity environment, to suppress decrease in an amount of electric charge, to suppress environmental difference of charging, and to attain an effect of enhancing environmental stability of carrier charging performance. Furthermore, if humidity is high, an amount of electric charge decreases to induce overdevelopment, and also induce toner contamination in a machine, such as scattering or fogging. Since humidity varies even during one day, image forming apparatuses (particularly, medium quality and high quality machines) are provided with a device for control of correction for humidity environment. However, the production of a two-component developer having a small environmental difference such as of the present Examples is preferable from the viewpoint of cost reduction because of no need for a device for control of correction for humidity environment.

What is claimed is:

1. A two-component developer comprising a toner, and a carrier having a surface of a core material particle coated with a resin, wherein the resin is a vinyl polymer having a unit of the following general formula (1):

General Formula (1)

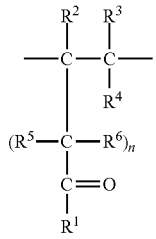

wherein $R^1$ represents an optionally substituted cycloalkyl group of 3 to 10 carbon atoms; $R^2$ represents a hydrogen atom or a methyl group; $R^3$ and $R^4$ each represent a hydrogen atom; $R^5$ and $R^6$ each independently represent a hydrogen atom or an alkyl group; and n is an integer of 0 or greater.

2. The two-component developer according to claim 1, wherein the vinyl polymer is a homopolymer of the unit of the general formula (1).

3. The two-component developer according to claim 1, wherein $R^1$ represents a cyclohexyl group or a cyclohexyl group substituted with at least one of an alkyl group of 1 to 4 carbon atoms or an alkoxy group of 1 to 5 carbon atoms.

4. The two-component developer according to claim 3, wherein $R^1$ represents a cyclohexyl group or a cyclohexyl group substituted with an alkyl group of 1 to 4 carbon atoms.

5. The two-component developer according to claim 1, wherein the unit of the general formula (1) is a partial structure of the vinyl polymer formed from at least one vinyl polymerizable monomer selected from the group consisting of 1-cyclopropyl-2-methyl-2-propen-1-one, 1-cyclobutyl-2-methyl-2-propen-1-one, 1-cyclopentyl-2-methyl-2-propen-1-one, 1-cyclohexyl-2-methyl-2-propen-1-one, 1-cycloheptyl-2-methyl-2-propen-1-one, 1-adamantyl-2-methyl-2-propen-1-one, 1-cyclohexyl-3-methyl-3-buten-1-one, and 2-methyl-1-(2-methylcyclohexyl)-2-propen-1-one.

6. The two-component developer according to claim 5, wherein the unit of the general formula (1) is a partial structure of the vinyl polymer formed from 1-cyclohexyl-2-methyl-2-propen-1-one.

7. The two-component developer according to claim 1, wherein the resin is a copolymer having the unit of the general formula (1) and a unit of the following general formula (2):

General Formula (2)

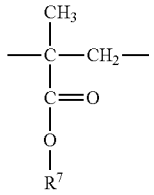

wherein $R^7$ represents an alkyl group or a cycloalkyl group.

8. The two-component developer according to claim 7, wherein a weight ratio of the unit of the general formula (1) and the unit of the general formula (2) used at the time of forming the copolymer resin is 10/90 to 90/10.

9. The two-component developer according to claim 8, wherein the weight ratio of the unit of the general formula (1) and the unit of the general formula (2) used at the time of forming the copolymer resin is 50/50 to 80/20.

10. The two-component developer according to claim 1, wherein an amount of the resin is in the range of 1.0 to 4.5% by weight, relative to an amount of the core material particle.

11. The two-component developer according to claim 10, wherein an amount of the resin is in the range of 3 to 3.5% by weight, relative to an amount of the core material particle.

12. The two-component developer according to claim 1, wherein a weight average molecular weight of the resin is 200,000 to 800,000.

13. The two-component developer according to claim 1, wherein the core material particle is formed of light metal ferrite.

14. The two-component developer according to claim 1, wherein the toner contains a styrene-acrylic copolymer resin or a polyester-based resin.

15. The two-component developer according to claim 1, wherein the toner is mixed in an amount of 2 to 15 parts by weight relative to 100 parts by weight of the carrier.

16. A two-component developer comprising a toner, and a carrier having a surface of a core material particle coated with a resin, wherein the resin is a vinyl polymer having a unit of the following general formula (1):

General Formula (1)

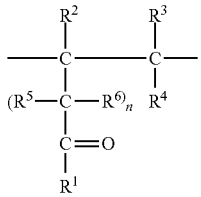

wherein $R^1$ represents an optionally substituted phenyl group; $R^2$ represents a hydrogen atom or a methyl group; $R^3$ and $R^4$ each represent a hydrogen atom; $R^5$ and $R^6$ each independently represent a hydrogen atom or an alkyl group; and n is an integer of 0 or greater, and a unit of the following general formula (2):

General Formula (2)

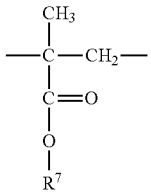

wherein $R^7$ represents an alkyl group or a cycloalkyl group.

17. The two-component developer according to claim 16, wherein the unit of the general formula (1) is a partial structure of the vinyl polymer formed from at least one vinyl polymerizable monomer selected from the group consisting of 2-methyl-1-phenyl-2-propen-1-one, 3-methyl-1-phenyl-3-buten-1-one, and 2-methyl-1-tolyl-2-propen-1-one.

18. The two-component developer according to claim 16, wherein a weight ratio of the unit of the general formula (1) and the unit of the general formula (2) used at the time of forming the copolymer resin is 10/90 to 90/10.

19. The two-component developer according to claim 18, wherein the weight ratio of the unit of the general formula (1) and the unit of the general formula (2) used at the time of forming the copolymer resin is 50/50 to 80/20.

20. The two-component developer according to claim 16, wherein a weight average molecular weight of the resin is 200,000 to 800,000.

* * * * *